US007794041B2

(12) United States Patent
Akase et al.

(10) Patent No.: US 7,794,041 B2
(45) Date of Patent: Sep. 14, 2010

(54) LIQUID EJECTING APPARATUS AND MAINTENANCE METHOD THEREOF

(75) Inventors: Takashi Akase, Azumino (JP); Koji Morikoshi, Shiojiri (JP); Keiji Matsumoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 823 days.

(21) Appl. No.: 11/690,049

(22) Filed: Mar. 22, 2007

(65) Prior Publication Data

US 2007/0257956 A1 Nov. 8, 2007

(30) Foreign Application Priority Data

| | | |
|---|---|---|
| Mar. 23, 2006 | (JP) | 2006-080664 |
| Jul. 20, 2006 | (JP) | 2006-198316 |
| Oct. 19, 2006 | (JP) | 2006-284871 |

(51) Int. Cl.
*B41J 29/393* (2006.01)

(52) U.S. Cl. ..... 347/19; 347/29; 347/30

(58) Field of Classification Search ..... 347/14, 347/19, 22–36
See application file for complete search history.

(56) References Cited

U.S. PATENT DOCUMENTS 6,036,299 A * 3/2000 Kobayashi et al. ..... 347/30

FOREIGN PATENT DOCUMENTS

JP 2001-026112 A 1/2001

* cited by examiner

*Primary Examiner*—Juanita D Stephens
(74) *Attorney, Agent, or Firm*—Workman Nydegger

(57) ABSTRACT

The ink jet type printer is equipped with a recording head for ejecting ink including humectant and water from a nozzle formed on a nozzle forming surface and a cap which can seal the nozzle forming surface of the recording head. Further, the ink jet type printer is equipped with a control section for detecting an amount of the ink discharged into the cap from the nozzle, for calculating an available water amount which is a water amount except water absorbed by humectant in the ink in the cap based on the detected ink amount, and for performing maintenance control for forcibly discharging ink into the cap from the nozzle so that the amount of the ink discharged from the nozzle becomes smaller when the calculated available water amount is large than when small.

9 Claims, 15 Drawing Sheets

| | |
|---|---|
| TIMER CLEANING | FIRST TIMER CLEANING PATTERN TCL1 |
| | SECOND TIMER CLEANING PATTERN TCL2 |

| | |
|---|---|
| FLUSHING | FIRST FLUSHING PATTERN FL1 |
| | SECOND FLUSHING PATTERN FL2 |
| | THIRD FLUSHING PATTERN FL3 |
| | FOURTH FLUSHING PATTERN FL4 |

| AVAILABLE WATER AMOUNT W IN CAP (mg) | DISCHARGE INK AMOUNT HI (mg) | MAINTENANCE PATTERN TO BE PERFORMED |
|---|---|---|
| NEGATIVE VALUE | 200 | CLEANING PATTERN CL |
| NOT LESS THAN 0 AND LESS THAN 50 | 160 | FOURTH FLUSHING PATTERN FL4 |
| NOT LESS THAN 50 AND LESS THAN 100 | 120 | THIRD FLUSHING PATTERN FL3 |
| NOT LESS THAN 100 AND LESS THAN 150 | 80 | SECOND FLUSHING PATTERN FL2 |
| NOT LESS THAN 150 | 40 | FIRST FLUSHING PATTERN FL1 |

FIG. 23

| | AVERAGE ATMOSPHERE TEMPERATURE Q | AVERAGE ATMOSPHERE HUMIDITY R | AVERAGE ATMOSPHERE TEMPERATURE Q | AVERAGE ATMOSPHERE HUMIDITY R | AVERAGE ATMOSPHERE TEMPERATURE Q | AVERAGE ATMOSPHERE HUMIDITY R |
|---|---|---|---|---|---|---|
| | 25°C | 42%RH | 29°C | 35%RH | 29°C | 22%RH |
| ELAPSED TIME TX | DISCHARGE INK AMOUNT HI | | DISCHARGE INK AMOUNT HI | | DISCHARGE INK AMOUNT HI | |
| 10 DAYS | 40 mg | | 80 mg | | 120 mg | |
| ONE MONTH | 80 mg | | 120 mg | | 160 mg | |
| SIX MONTHS | 120 mg | | 160 mg | | 200 mg | |

LIQUID EJECTING APPARATUS AND MAINTENANCE METHOD THEREOF

TECHNICAL FIELD

The present invention relates to a liquid ejecting apparatus such as, for example, an ink jet type printer and the like, and to a maintenance method thereof.

BACKGROUND ART

Generally, in an ink jet type printer which is a type of a liquid ejecting apparatus (hereinafter, referred to as a "printer"), printing is performed by ejecting ink (liquid) to a recording medium from a nozzle formed on a nozzle forming surface of a recording head (liquid ejecting head) mounted in a carriage. In this case, water of the ink in the nozzle is easy to evaporate from the opening of the nozzle, so that the clogging of the nozzle is easy to occur due to the increase of the viscosity of the ink in the nozzle. Accordingly, in such a printer, the clogging of the nozzle is to be eliminated by performing maintenance (cleaning, flushing, or the like) for forcibly discharging the ink in the nozzle on regular basis.

In addition, when the printer is pausing, water evaporation of the ink from the opening of the nozzle is to be restrained by sealing the nozzle forming surface of the recording head by a cap. However, humectant is added in the ink for improving ejection stability of the ink from the nozzle and the like, so that the humectant remains in the cap when the cleaning is performed. Accordingly, the humectant remaining in the cap not only absorbs the water in the cap but also deprives the water from the ink in the nozzle. As a result, there is a problem in that the viscosity of the ink in the nozzle is increased to cause ejection trouble of the ink.

Consequently, the printer has been proposed which restrains water to be deprived by a moisture retention component in the cap from the ink in the cap by reducing a ratio of the moisture retention component in the cap by ejecting the ink whose moisture retention component (humectant) is the smallest into the cap before the printer shifts to pausing state (for example see Patent document 1).

[Patent Document 1] JP-A-2001-26112

BRIEF DESCRIPTION OF THE DRAWINGS

FIG. 23 is a table showing a concrete example when a process based on a head maintenance process routine before starting printing of the second embodiment was performed.

DISCLOSURE OF THE INVENTION

Figure 1:
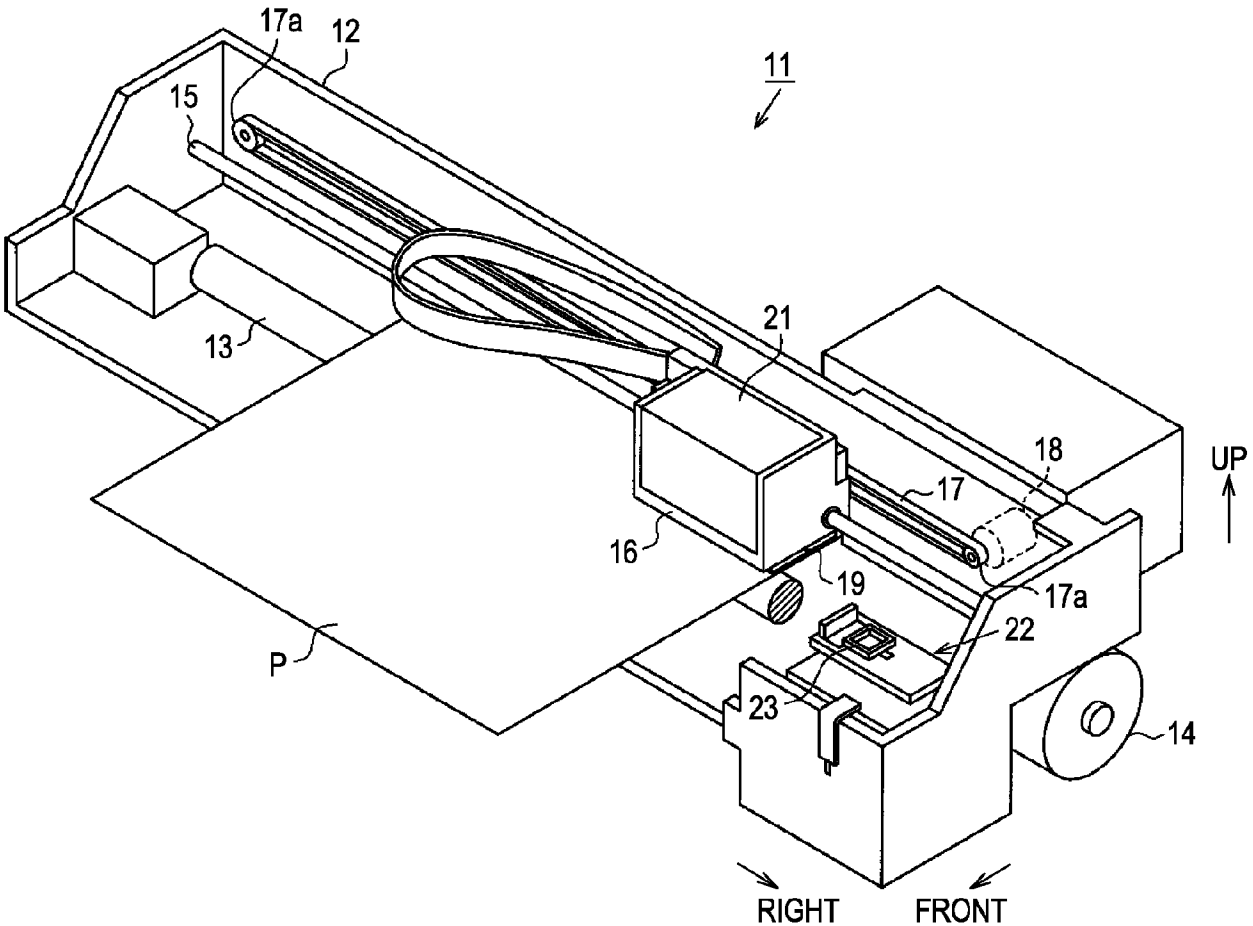
FIG. 1 is a perspective view of an ink jet type printer of a first embodiment.

By the way, in the printer of Patent Document 1, the state (ratio of water and moisture retention component, or the like) of the ink exists in the cap is not administrated although the ink having a composition comprising the smallest moisture retention component is to be ejected into the cap before the printer shifts to pausing state. That is, in the printer of Patent Document 1, cleaning is performed not in consideration of affection provided to the ink in the nozzle by the moisture retention component exist in the cap, so that there is a problem in that ejection trouble of ink at print start time cannot surly be restrained.

The invention is made in light of the problem exists in such a conventional technique. The object of the invention is to provide a liquid ejecting apparatus which makes it possible to surely restrain ejection trouble of liquid at liquid ejection start time and a maintenance method thereof.

In order to attain the object described above, a liquid ejecting device of the invention equipped with a liquid ejecting head for ejecting liquid including humectant and water from a nozzle formed on a nozzle forming surface and a cap which can seal the nozzle forming surface of the liquid ejecting head includes liquid amount detecting unit that detect an amount of the liquid discharged into the cap from the nozzle, available water amount calculating unit that calculates an available water amount which is a water amount except water absorbed by humectant in the liquid in the cap based on a result detected by the liquid amount detecting unit, and control unit that performs maintenance control for forcibly discharging liquid from the nozzle into the cap based on a result calculated by the available water amount calculating unit so that the amount of the liquid discharged from the nozzle becomes smaller when the available water amount is large than when small.

The clogging of the nozzle tends to occur as the available water amount in the liquid exist in the cap decreases in the sate where the nozzle forming surface of the liquid ejecting head is sealed by the cap, that is, during pausing of liquid ejection. Accordingly, ejection trouble of liquid tends to occur at liquid ejection start time. Accordingly, it is necessary to increase the amount of the liquid discharged into the cap from the nozzle as the available water amount in the liquid exist in the cap decreases at the maintenance time for forcibly discharging the liquid into the cap from the nozzle. In this regard, according to the invention, maintenance control for forcibly discharging the liquid into the cap from the nozzle is performed so that the liquid amount discharged from the nozzle becomes small when the available water amount in the liquid exist in the cap is large than when small. Accordingly, ejection trouble of liquid at liquid ejection start time can be surly restrained.

The liquid ejecting apparatus of the invention includes non-sealing duration time measuring unit that measures a non-sealing duration time of the nozzle forming surface by the cap for every one time, sealing duration time measuring unit that measures a sealing duration time of the nozzle forming surface by the cap for every one time, and non-sealing cumulative time measuring unit that measures a non-sealing cumulative time of the nozzle forming surface by the cap. The available water amount calculating unit calculates the available water amount based on a result measured by the non-sealing duration time measuring unit, a result measured by the sealing duration time measuring unit, and a result measured by the non-sealing cumulative time measuring unit.

According to the invention, calculation accuracy of the available water amount can be improved by calculating the available water amount based on the sealing duration time, the non-sealing duration time, and the non-sealing cumulative time of the nozzle forming surface by the cap.

In the liquid ejecting apparatus of the invention, when the available water amount based on a result calculated by the available water amount calculating unit is smaller than an initial available water amount in the cap in a preliminarily set initial state, the control unit performs the maintenance control so that the liquid of a liquid amount including the available water amount corresponding to the difference of the available water amount and the initial available water amount is to be ejected from the nozzle into the cap after finishing liquid ejection.

According to the invention, for example, if the available water amount in the cap right after cleaning is set to the initial available water amount in the initial state so that the inside of the cap is to be a high wet state, when the available water amount in the cap decreases than the initial available water amount, the maintenance control is performed to compensate the difference. That is, liquid is supplemented into the cap and the available water amount in the cap is returned to the initial available water amount. Accordingly, the inside of the cap can be maintained in a high wet condition, which makes it possible to preferably restrain the clogging of the nozzle.

The liquid ejecting apparatus according to the invention further includes suction unit which can suction the inside of the cap. The control unit performs the maintenance control by operating the suction unit to perform suction so that the humectant is to be discharged from the cap when the amount of the humectant discharged into the cap exceeds a preliminarily set predetermined amount.

According to the invention, the humectant amount in the cap can be restrained not more than a preliminarily set predetermined amount, so that the water amount deprived from the liquid in the nozzle by the humectant in the cap is reduced. Accordingly, clogging of the nozzle can be preferably restrained.

In the liquid ejecting apparatus according to the invention, the control unit calculates a discharge liquid amount which is an amount of the liquid forcibly discharged into the cap from the nozzle based on the available water amount and performs the maintenance control so that the liquid of the calculated discharge liquid amount is to be forcibly discharged from the nozzle into the cap before starting liquid ejection.

The clogging of the nozzle tends to occur as the available water amount in the liquid exists in the cap decreases in the sate where the nozzle forming surface of the liquid ejecting head is sealed by the cap, that is, during pausing of liquid ejection. Accordingly, ejection trouble of liquid tends to occur at liquid ejection start time. Accordingly, it is necessary to increase the discharge liquid amount discharged into the cap from the nozzle as the available water amount in the liquid exist in the cap decreases at the maintenance time for forcibly discharging the liquid into the cap from the nozzle. However, in this case, increase of the discharge liquid amount more than necessity result in useless consumption of the liquid. In this regard, according the invention, the discharge liquid amount is determined based on the available water mount in the liquid exist in the cap. Accordingly, waste of the liquid when forcibly discharged into the cap from the nozzle before starting liquid ejection can be eliminated.

In the liquid ejecting apparatus of the invention, the control unit measures an elapsed time from the previous liquid ejection finish time, calculates a cumulative water penetration amount penetrated from inside of the cap to outside of the cap from the previous liquid ejection finish time based on the measured result, and calculates the available water amount based on the calculated cumulative water penetration amount.

According to the invention, the available water amount is calculated based on the cumulative water penetration amount penetrated from inside of the cap to outside of the cap from the previous liquid ejection finish time. Accordingly, calculation accuracy of the available water amount can be improved.

The liquid ejecting apparatus of the invention includes temperature measuring unit that measures an atmosphere temperature of the liquid ejecting head. The control unit calculates the cumulative water penetration amount based on a result of the atmosphere temperature measured by the temperature measuring unit during the elapsed time.

According to the invention, the cumulative water penetration amount is determined based on the atmosphere temperature of the liquid ejecting head during the elapsed time from the previous liquid ejection finish time. Accordingly, calculation accuracy of the cumulative water penetration amount can be improved.

The liquid ejecting apparatus of the invention includes humidity measuring unit that measures an atmosphere humidity of the liquid ejecting head. The control unit calculates the cumulative water penetration amount based on a result of the atmosphere humidity measured by the humidity measuring unit during the elapsed time.

According to the invention, the cumulative water penetration amount is determined based on the atmosphere humidity of the liquid ejecting head during the elapsed time from the previous liquid ejection finish time. Accordingly, calculation accuracy of the cumulative water penetration amount can be improved.

A maintenance method of a liquid ejecting apparatus of the invention equipped with a liquid ejecting head for ejecting liquid including humectant and water from a nozzle formed on a nozzle forming surface and a cap which can seal the nozzle forming surface of the liquid ejecting head includes detecting an amount of the liquid discharged into the cap from the nozzle, calculating an available water amount which is a water amount except water absorbed by humectant in the liquid in the cap based on the detected amount of the liquid, and performing maintenance for forcibly discharging liquid from the nozzle into the cap so that the amount of the liquid discharged from the nozzle becomes smaller when the calculated available water amount is large than when small.

The clogging of the nozzle tends to occur as the available water amount in the liquid exists in the cap decreases in the sate where the nozzle forming surface of the liquid ejecting head is sealed by the cap, that is, during pausing of liquid ejection. Accordingly, ejection trouble of liquid tends to occur at liquid ejection start time. Accordingly, it is required to increase the amount of the liquid forcibly discharged into the cap from the nozzle as the available water amount decreases at the maintenance time. In this regard, according the invention, maintenance for forcibly discharging the liquid into the cap from the nozzle is performed so that the liquid amount discharged from the nozzle becomes smaller when the available water amount is large than when small. Accordingly, ejection trouble of liquid at liquid ejection start time can be surly restrained.

First Embodiment

Hereinafter, a first embodiment in which a liquid ejecting apparatus of the invention is embodied in an ink jet type printer will be described based on the drawings. Note that "front and back direction", "up and down direction", and "left and right direction" correspond to the "front and back direction", "up and down direction", and "left and right direction" when FIG. 1 is regarded as a standard unless there is any special description.

As shown in FIG. 1, an ink jet type printer 11 as the liquid ejecting apparatus is equipped with a frame 12 having a rectangle shape when viewed in a plane manner. A platen 13 extending in the left and right direction is provided in the frame 12 and a recording paper P is to be transported to be provided on the platen 13 from the back side by a paper transporting mechanism having a paper transport motor 14 provided on a back surface of the frame 12. Further, a guide member 15 in the shape of a rod is provided in parallel with the longitudinal direction (left and right direction) of the platen 13 on the upper side of the platen 13 in the frame 12.

A carriage 16 is supported by the guide member 15 so that the carriage 16 can be reciprocated along the axis line direction (left and right direction) of the guide member 15. The carriage 16 is coupled with and driven by a carriage motor 18 provided at a back surface of the flame 12 via a timing belt 17 provided between a pair of pulleys 17*a* provided on a rear surface in the frame 12. Accordingly, the carriage 16 is to be reciprocated along the guide member 15 by driving the carriage motor 18.

A recording head 19 as a liquid ejecting head is provided on the lower surface of the carriage 16 and the lower surface of the recording head 19 is to be a nozzle forming surface 19*a* (see FIG. 2) on which a plurality of (four in the embodiment) nozzles 20 (see FIG. 2) are formed. In addition, an ink cartridge 21 is mounted on the upper side of the recording head 19 in the carriage 16 so as to be able to be attached thereto and detached therefrom. In addition, inks in the form of liquid are respectively accommodated in the ink cartridge 21 so as to be able to be supplied to the recording head 19.

A humectant and water are included in the ink. Multiple alcohol such as glycerin or diethylene glycol is used as the humectant. The multiple alcohol has hygroscopic property. Accordingly, inclusion of the multiple alcohol into the ink prevents increasing of the stickiness of the ink in the nozzle, and as a result, prevents the clogging of the nozzle.

Then, printing on the recording paper P is to be performed by supplying the ink in the ink cartridge 21 from the ink cartridge 21 to the recording head 19 and by ejecting the ink toward the recording paper P transported on the platen 13 from each nozzle 20 by driving piezo elements 20*a* (see FIG. 2) equipped so as to correspond to each nozzle 20 in the recording head 19. Further, a maintenance unit 22 for performing maintenance (cleaning, flushing, and the like) of the recording head at non-printing time is provided in a non-printing area positioned at right edge in the flame 12.

Figure 2:
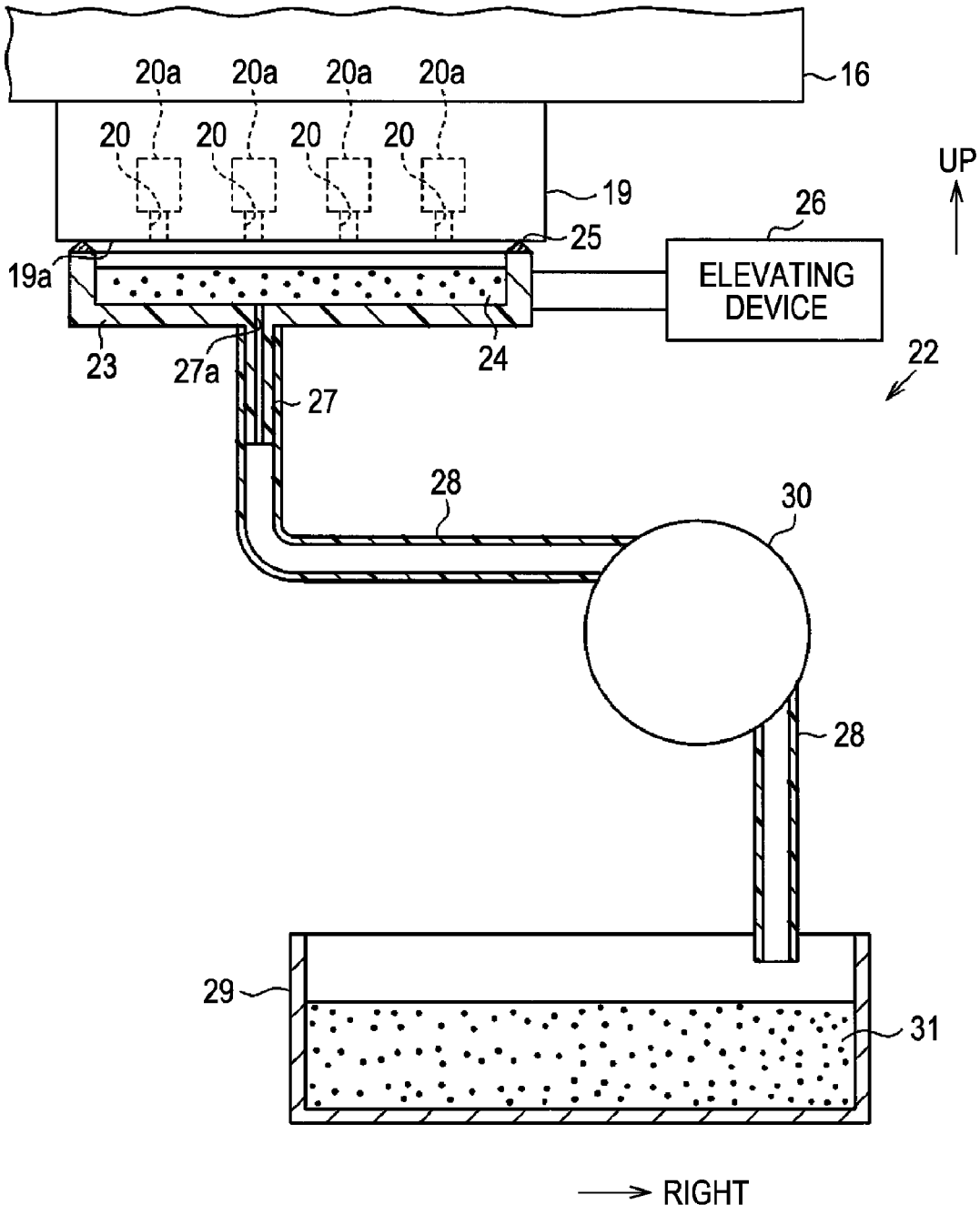
FIG. 2 is a simplified cross sectional view of a maintenance unit of the first embodiment.

As shown in FIG. 2, the maintenance unit 22 includes a bottom equipped box-shaped resin cap 23 whose upper side enabling to seal the nozzle forming surface 19*a* of the recording head 19 is opened. The thickness of all of the wall portions (bottom wall and peripheral walls) of the cap 23 is even. A square platy ink absorbent 24 formed by a porous material having flexibility is provided so as to cover the whole bottom surface in the cap 23. A seal member 25 of square frame shape formed by a flexible member such as a gum is provided on the whole upper surface of the cap 23 so as to adhere thereto.

Further, an elevator device 26 for moving the cap 23 up and down is coupled to the cap 23. Then, in the state where the carriage 16 is moved to a non-printing area, the upper surface of the seal member 25 is made contact with the nozzle forming surface 19*a* of the recording head 19 and each nozzle 20 is to be sealed by the cap 23 by raising the cap 23 by the elevator device 26. Note that in the state where the nozzle forming surface 19*a* is sealed by the cap 23, the ink absorbent 24 absorbs and keeps the ink in the cap to keep the water of the space in the cap 23.

A discharge section 27 having a discharge channel 27*a* for discharging the ink from inside of the cap 23 to outside of the cap 23 is provided on the lower surface of the cap 23 so as to extend to the lower side. The proximal end side (upstream side) of a discharge tube 28 formed by a flexible material is connected with the discharge section 27 and the inside of the cap 23 and the inside of the discharge tube 28 are communicated via the discharge channel 27*a*. The distal end side (downstream side) of the discharge tube 28 is inserted in a discharge ink tank 29 having a rectangular solid shape. In addition, in the intermediate portion of the discharge tube 28, a tube pump 30 as suction unit that sucks the inside of the cap 23 from the cap 23 side towered the discharge ink tank 29 side is provided.

Then, the stickiness increased ink in each nozzle 20 is sucked with air bubble and the like to be discharged into the discharge ink tank 29 via the cap 23 and the discharge tube 28, that is, so called cleaning is to be performed by driving the tube pump 30 in the state where the nozzle forming surface 19*a* (each nozzle 20) of the recording head 19 is sealed by the cap 23. Note that, a discharge ink absorbent 31 for absorbing and keeping the ink discharged into the discharge ink tank 29 is accommodated in the discharge ink tank 29.

Next, an electronic structure of the ink jet type printer 11 will be described.

Figures 3, 4, 5:
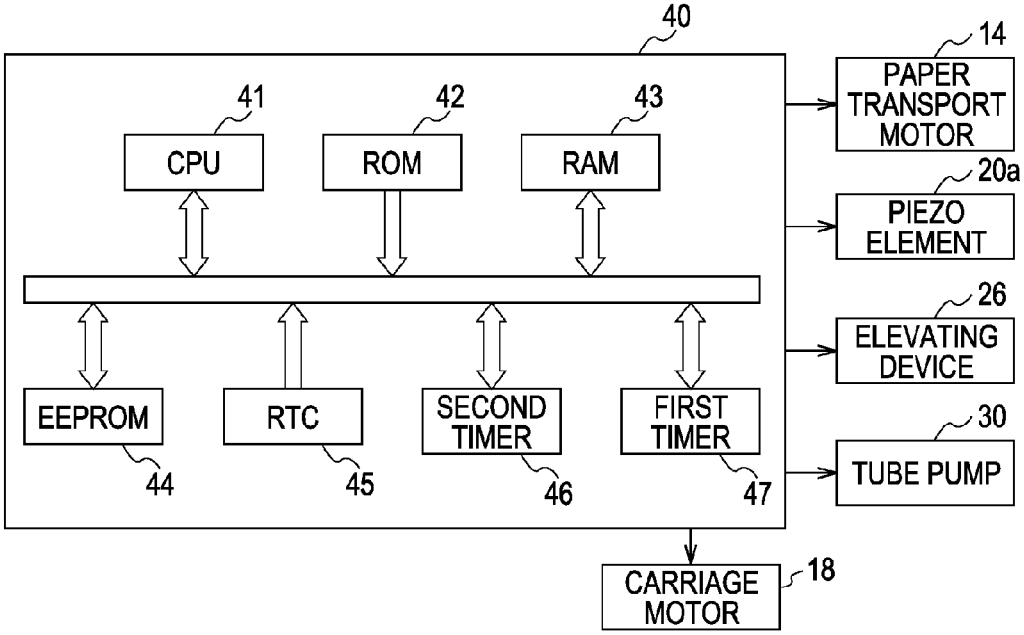
FIG. 3 is a block circuit diagram showing an electronic structure of the ink jet type printer of the first embodiment.
FIG. 4 is a table showing each timer cleaning pattern of the first embodiment.
FIG. 5 is a table showing each flushing pattern of the first embodiment.

As shown in FIG. 3, the ink jet type printer 11 is equipped with a control section 40 as liquid quantity detecting unit, available water amount calculating unit, and control unit. The paper transport motor 14, the carriage motor 18, the piezo elements 20*a*, the elevator device 26, the tube pump 30, and the like are electrically connected with the control section 40. Then, the driving states of the both motors 14 and 18, the piezo elements 20*a*, the elevator device 26, the tube pump 30, and the like are to be controlled by the control section 40.

A CPU 41, a ROM 42, a RAM 43, an EEPROM (Electronically Erasable and Programmable Read Only Memory) 44, a RTC (Real Time Clock) 45, a second timer 46 as non-sealing cumulative time measuring unit, a first timer 47 as non-sealing duration time measuring unit and sealing duration time measuring unit, and the like are provided in the control section 40. Each control program for controlling the ink jet type printer 11, various information (tables showing each cleaning pattern and each flushing pattern described below), and the like are stored in the ROM 42. Various information is to be appropriately rewritten into the RAM 43 during driving the ink jet type printer 11. In addition, the CPU 41 is equipped with a counting function for accumulating and counting the ink amount ejected into the cap 23 by flushing. The accumulated and counted ink amount is stored in a predetermined area of the EEPROM 44 as a CapCnt value.

Various information (previous cleaning time TB, previous flushing time TD, power source off time, previous print finish time TG, and the like described below) which should not be cleared even when the power source of the ink jet type printer 11 is turned off is to be recorded into the EEPROM 44. The RTC 45 can measure time not only of course when the power source of the ink jet type printer 11 is in on state but also after the power source of the ink jet type printer 11 is in off state as long as power is supplied from a capacitor not shown.

Next, tables stored in the ROM 42 will be described.

Timer cleaning patterns applied in the cleaning performed by the maintenance unit 22 of the embodiment are shown in the table shown in FIG. 4.

The timer cleaning is a cleaning performed in accordance with an elapsed time T1 from when the previous cleaning was performed recorded in the EEPROM 44. Then, in regards to the timer cleaning, in the embodiment, by having difference to the discharge amount of the ink from each nozzle 20 of the recording head 19, a plurality types of timer cleaning pattern, that is, a first timer cleaning pattern TCL1 and a second timer cleaning pattern TCL2 of two types are set. In this case, the discharge amount of the ink from each nozzle 20 of the recording head 19 in the first timer cleaning pattern TCL1 is set so as to be larger than that in the second timer cleaning pattern TCL2.

Flushing pattern applied in the flushing performed by the maintenance unit 22 of the embodiment are shown in the table shown in FIG. 5. Then, in regard to the flushing patterns, in the embodiment, by having difference to the discharge amount of the ink from each nozzle 20 of the recording head 19, a plurality types of flushing patterns, that is, a first flushing pattern FL1, a second flushing pattern FL2, a third flushing pattern FL3, and a fourth flushing pattern FL4 of four types are set.

In this case, each flushing patterns FL1 to FL4 are set so that the discharge amount of the ink from each nozzle 20 of the recording head 19 becomes larger in a phased manner in the order of the first flushing pattern FL1, the second flushing pattern FL2, the third flushing pattern FL3, and the fourth flushing pattern FL4. That is, the discharge amount of the ink from each nozzle 20 of the recording head 19 is set to be the smallest in the first flushing pattern FL1 and the largest in the fourth flushing pattern FL4. Note that the discharge amount of the ink from each nozzle 20 of the recording head 19 in the second timer cleaning pattern TCL2 is set larger than that in the fourth flushing pattern FL4.

Figure 6:
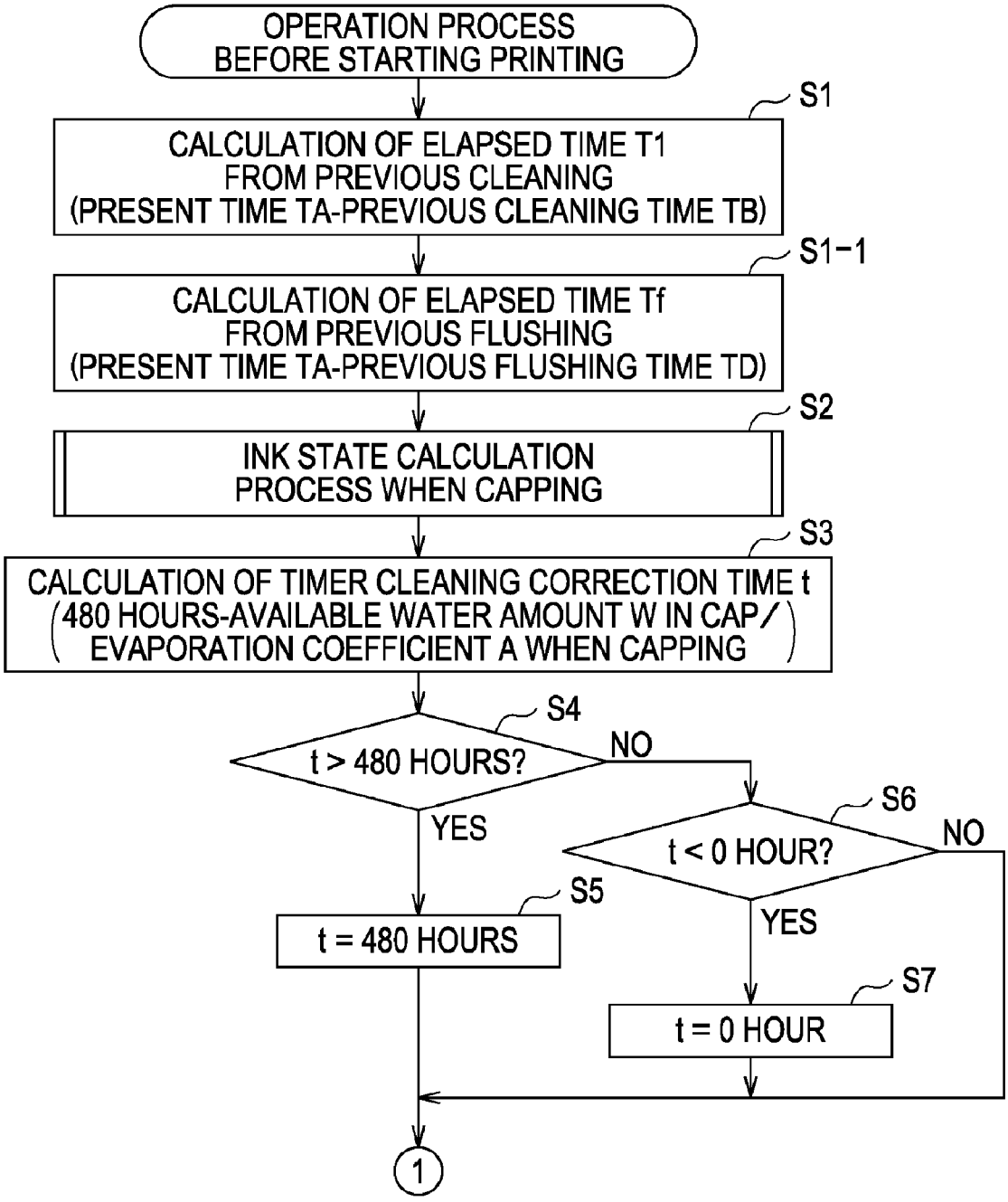
FIG. 6 is a flow chart showing an operation process routine before starting printing of the first embodiment.

Next, an operation process routine before stating printing for performing maintenance of the recording head 19 by the maintenance unit 22 before starting printing among a control process routine performed by the control unit 40 of the embodiment will be described based on FIG. 6 and FIG. 7.

The control unit 40 reads out the previous cleaning time TB which is a time when cleaning was previously performed from the EEPROM 44 and reads out the present time TA from the RTC 45 to subtract the previous cleaning time TB from the present time TA, thereby calculating the elapsed time T1 from when the previous cleaning was performed (step S1). Subsequently, the control section 40 reads out the previous flushing time TD which is a time when flushing was previously performed from the EEPROM 44 and reads out the present time TA from the RTC45 to subtract the previous flushing time TD from the present time TA, thereby calculating an elapsed time Tf from when the flushing was previously performed.

Figure 16:
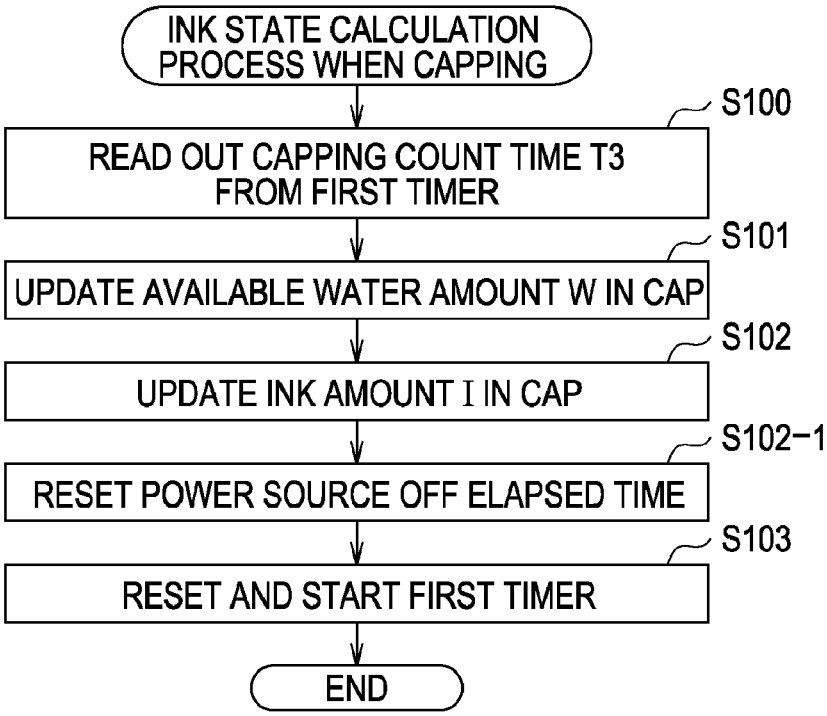
FIG. 16 is a flow chart showing an ink state calculation process routine when capping of the first embodiment.

Subsequently, the control section 40 performs ink state calculation process when capping described below (ink state calculation process routine when capping shown in FIG. 16) (step S2). In the step S2, an available water amount W in the cap which is a water amount except the water absorbed by a humectant in the ink in the cap 23 is calculated.

Subsequently, the control section 40 calculates a timer cleaning correction time t for correcting an interval time for performing timer cleaning (step S3). That is, the control section 40 reads out 480 hours which is the maximum value of the timer cleaning interval time and an evaporation coefficient A when capping preliminarily stored in the ROM 42 from the ROM 42 to subtract the value obtained by dividing the available water amount W in the cap calculated in step S2 by the evaporation coefficient A when capping from 480 hours, thereby calculating the timer cleaning correction time t. Note that 480 hours which is the maximum value of the timer cleaning interval time and the evaporation coefficient A when capping are values obtained by preliminarily performing an experiment or the like.

Subsequently, the control section 40 judges whether the timer cleaning correction time t calculated in step S3 is not less than 480 hours or not (step S4). When the judged result in step S4 is positive, the control section 40 set the timer cleaning correction time t to 480 hours (step S5), and thereafter shifts the process to step S8 described below. On the other hand, when the judged result in step S4 is negative, the control section 40 judges whether the timer cleaning correction time t is less than 0 hour or not (step S6).

When the judged result in step S6 is positive, the control section 40 set the timer cleaning correction time t to 0 hour (step S7), and thereafter shifts the process to step S8 described below. On the other hand, when the judged result in step S6 is negative, the control section 40 shifts the process to step S8 described below.

In step S8, the control section 40 judges whether the elapsed time T1 calculated in step S1 is not less than 480 hours or not. When the judged result in step S8 is positive, the control section 40 performs the first timer cleaning pattern TCL1 (step S9), and thereafter shifts the process to step S12 described below. On the other hand, when the judged result in step S8 is negative, the control section 40 judges whether the timer cleaning correction time t calculated in step S3 is not less than 480 hours or not (step S10). When the judged result in step S10 is positive, the control section 40 performs the second timer cleaning pattern TCL2 (step S11), and thereafter shifts the process to step S12 described below.

In step S12, the control section 40 reads out the performance finish time of the first timer cleaning pattern TCL1 in step S9 or the performance finish time of the second timer cleaning pattern TCL2 in step 11 from the RTC 45. Then, the control section 40 sets the performance finish time read out from the RTC 45 as the previous cleaning time TB and writes the previous cleaning time TB into a predetermined area of the EEPROM 44. That is, the control section 40 updates the previous cleaning time TB. Then, the control section 40 finishes the operation process routine before starting printing.

On the other hand, when the judged result in step S10 is negative, the control section 40 judges whether the elapsed time Tf calculated in step S1-1 is less than 48 hours or not (step S13). When the judged result in step S13 is positive, the control section 40 performs the first flushing pattern FL1 (step S14), and shifts the process to step S20 described below. When the judged result in step S13 is negative, the control section 40 judges whether the elapsed time Tf calculated in step S1-1 is not less than 48 hours and less than 120 hours or not (step S15).

When the judged result in step S15 is positive, the control section 40 performs the second flushing pattern FL2 (step S16), and shifts the process to step S20 described below. When the judged result in step S15 is negative, the control section 40 judges whether the elapsed time Tf calculated in step S1-1 is not less than 120 hours and less than 360 hours or not (step S17).

When the judged result in step S17 is positive, the control section 40 performs the third flushing pattern FL3 (step S18), and shifts the process to step S20 described below. When the judged result in step S17 is negative, the control section 40 performs the fourth flushing pattern FL4 (step S19), and shift the process to step S20 described below.

In step S20, the control section 40 reads out the performance finish time of the first flushing pattern FL1 in step S14, the performance finish time of the second flushing pattern FL2 in step S16, the performance finish time of the third flushing pattern FL3 in step S18, or the performance finish time of the fourth flushing pattern FL4 in step S19 from the RTC 45. Then, the control section 40 sets the performance finish time read out from the RTC 45 as the previous flushing time TD to write the previous flushing time TD into a predetermined area of the EEPROM 44. That is, the control section 40 updates the previous flushing time TD. Then, the control section 40 finishes the operation process routine before starting printing.

Figure 8:
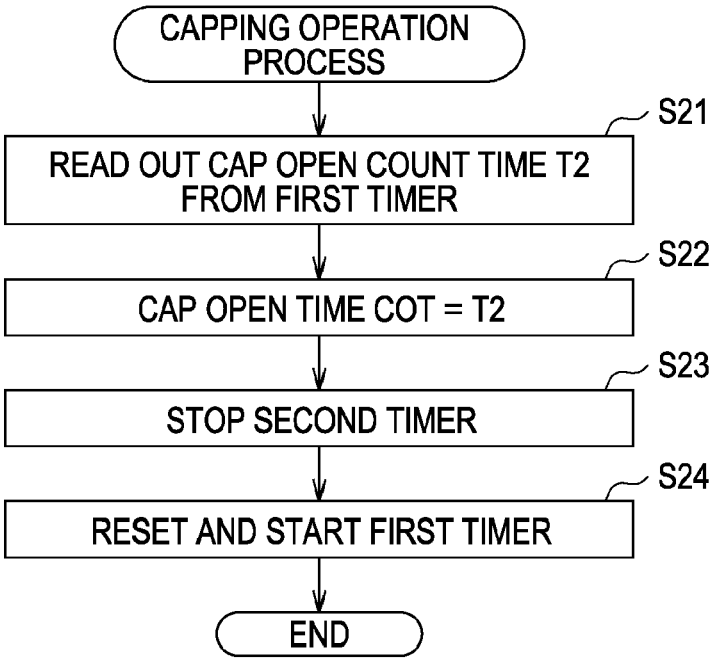
FIG. 8 is a flow chart showing a capping operation process routine of the first embodiment.

Next, a capping operation process routine performed when the cap 23 seals (capping) the nozzle forming surface 19*a* of the recording head 19 among the control process routine performed by the control section 40 of the embodiment will be described based on FIG. 8.

The control section 40 reads out a cap open count time T2 witch is a present count value from the first timer 47 counting the time while the cap 23 is opened for every one time (the time while the cap 23 is detached from the nozzle forming surface 19*a* of the recording head 19) (step S21). Subsequently, the control section 40 stores the cap open count time T2 read out in step S21 into the RAM 43 as a cap open time COT (non-sealing duration time).

Subsequently, the control section 40 stops the count of the time of the second timer 46 measuring the cumulative time while the cap 23 is opened (non-sealing cumulative time), that is the cumulative time while the cap 23 is detached from the nozzle forming surface 19*a* of the recording head 19 (step 23). Then, the control section 40 resets the count value of the first timer 47 and starts the count of the time of the first timer 47 (step 24).

Figure 9:
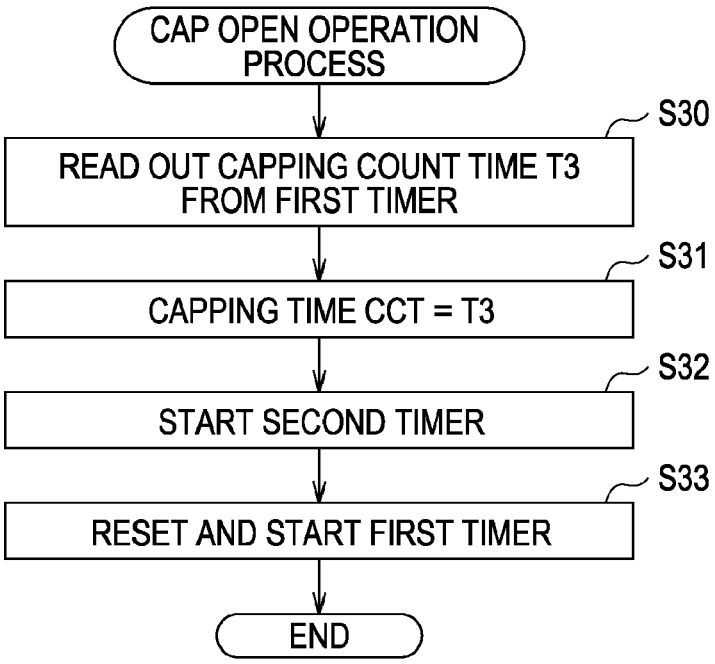
FIG. 9 is a flow chart showing a cap open operation process routine of the first embodiment.

Next, a cap open operation process routine performed when the cap 23 opens (non-sealing) the nozzle forming surface 19*a* of the recording head 19 among the control process routine performed by the control section 40 of the embodiment will be described based on FIG. 9.

The control section 40 reads out a capping count time T3 which is a present count value from the first timer 47 counting the time while the cap 23 seals the nozzle forming surface 19*a* of the recording head 19 for every one time (step S30). Subsequently, the control section 40 records the capping count time T3 read out in step S3 into the RAM 43 as a capping time CCT (sealing duration time) (step S31). Subsequently, the control section 40 starts the count of the time of the second timer 46 (step S32). Then, the control section 40 resets the count value of the first timer 47 and starts the count of the time of the first timer 47 (step S33).

Figure 18:
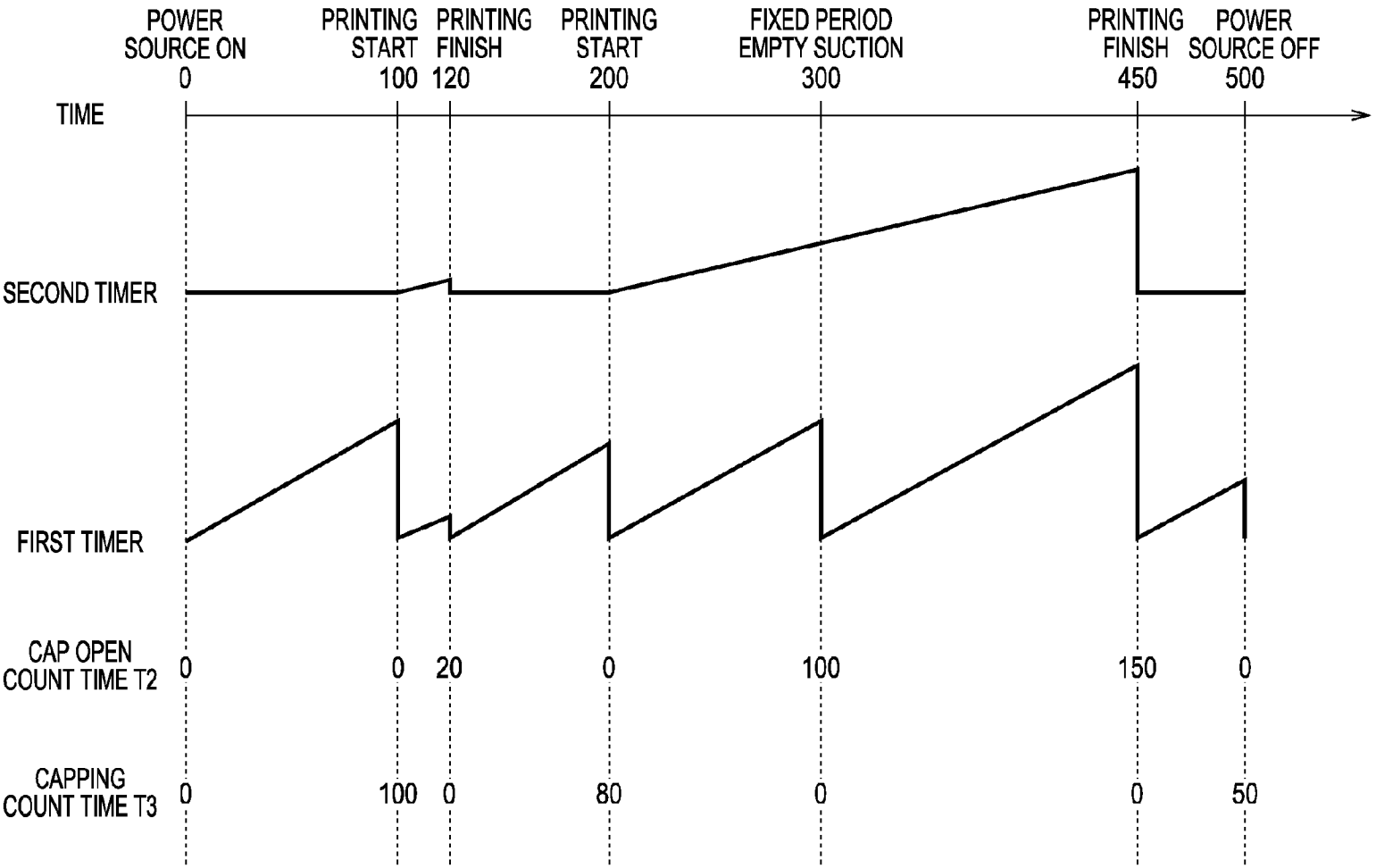
FIG. 18 is a timing chart showing operations of a first timer and a second timer of the first embodiment.

Here, an operation of the first timer 47 and the second timer 46 will be described based on the timing chart shown in FIG. 18.

For example, the case where the time when the power source of the ink jet type printer 11 was turned on should be 0, printing was started after 100 hours later, and printing was finished after 20 hours later from staring the printing will be described below.

When the power source is on, the nozzle forming surface 19*a* of the recording head 19 is sealed by the cap 23 and when printing is started, the nozzle forming surface 19*a* of the recording head 19 is opened by the cap 23. At print finish time, the nozzle forming surface 19*a* of the recording head 19 is sealed by the cap 23 again. In this case, the first timer 47 measures 100 hours of from the power source on time to the print start time as the capping count time T3 and measures 20 hours of from the print start time to the print finish time as the cap open count time T2. On the other hand, the second timer 46 does not count 100 hours of from the power source on time to the print start time and measures 20 hours of from the print start time to the print finish time as the cumulative time (non-sealing cumulative time) while cap 23 is opened.

Figure 10:
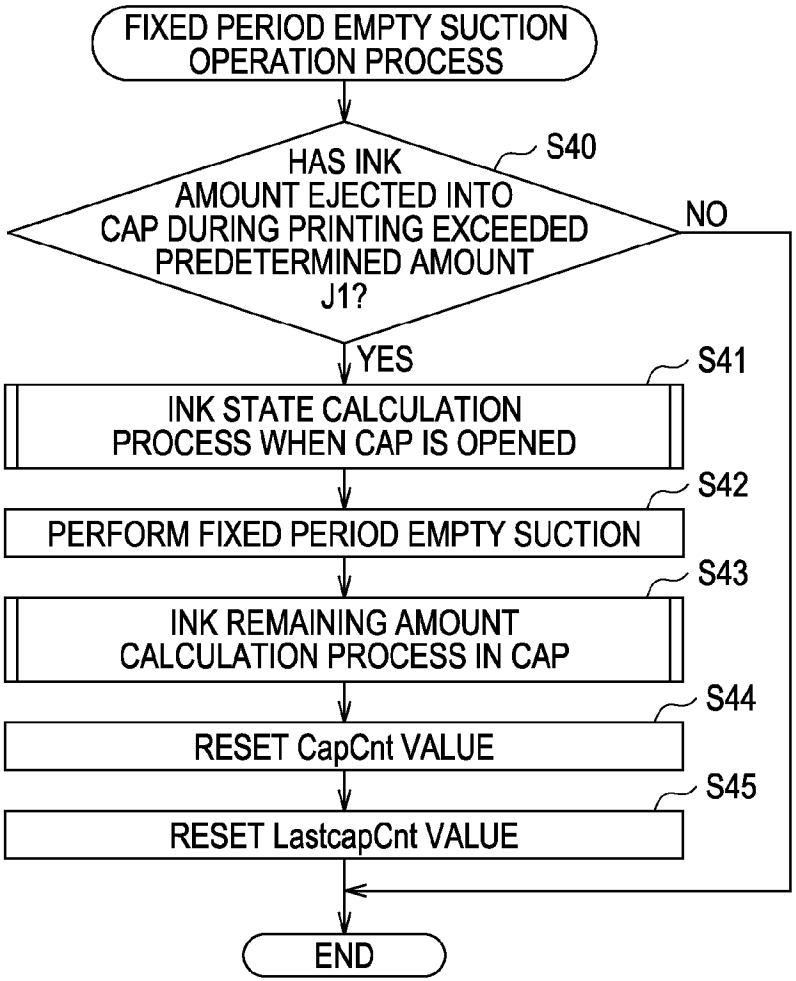
FIG. 10 is a flow chart showing a fixed period empty suction operation process routine of the first embodiment.

Next, a fixed period empty suction operation process routine performed during printing by the ink jet type printer 11 among the control process routine performed by the control section 40 of the embodiment will be described based on FIG. 10.

The control section 40 judges whether the ink amount flushed into the cap 23 during printing exceeds a predetermined amount J1 stored in the ROM 42 preliminarily set by experiment or the like or not (step S40). In this case, the ink amount ejected by driving of the piezo elements 20*a* of one time is preliminarily set, so that the ink amount flushed into the cap 23 during printing can be obtained by multiplying the driving number for flushing into the cap 23 by the piezo elements 20*a* by the ink amount ejected by driving of the piezo elements 20*a* of one time by the control section 40.

Figure 15:
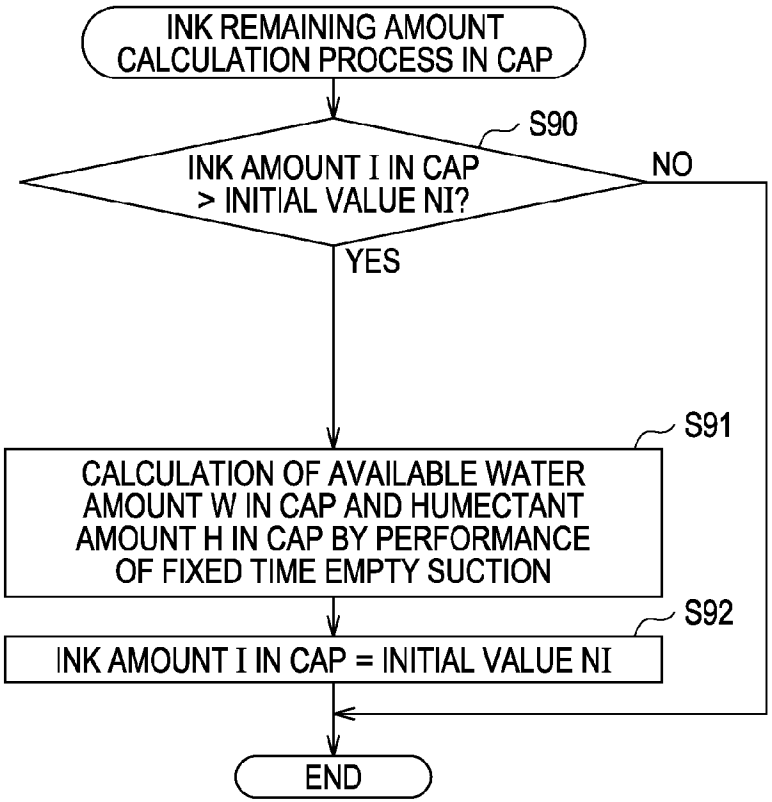
FIG. 15 is a flow chart showing an ink remaining amount calculation process routine in the cap of the first embodiment.

When the judged result in step S40 is positive, the control section 40 performs ink state calculation process at cap open time described below (ink state calculation process routine at cap open time shown in FIG. 15) (step S41). In the step S41, the available water amount W in the cap, a humectant amount H in the cap, an ink amount I in the cap, an available water amount ratio WH in the cap, and a humectant amount ratio HH in the cap are calculated. On the other hand, when the judged result in step S40 is negative, the control section 40 finishes the fixed period empty suction operation process routine.

Figure 14:
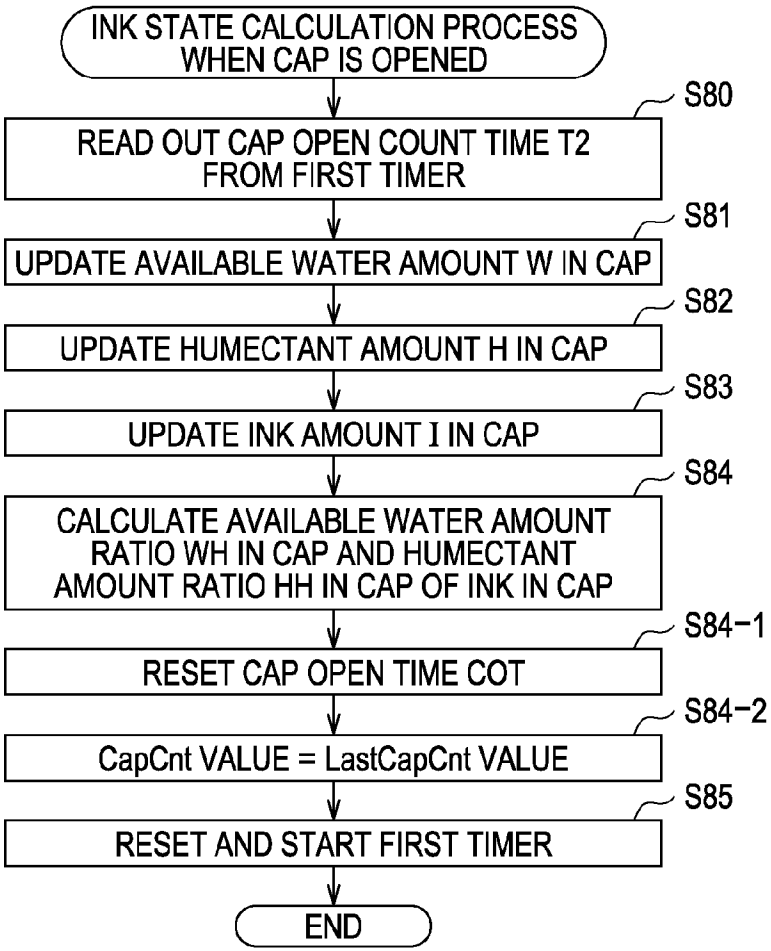
FIG. 14 is a flow chart showing an ink state calculation process routine when cap is opened of the first embodiment.

Subsequently, the control section 40 drives the tube pump 30 to perform fixed period empty suction for discharging the ink in the cap (step S42). The control section 40 continuously performs ink remaining amount calculation process in the cap described below (ink remaining amount calculation process routine in the cap shown in FIG. 14) (step S43). In step S43, the available water amount W in the cap and the humectant amount H in the cap after performing fixed period empty suction are calculated.

Subsequently, the control section 40 reads out the CapCnt value from the EEPROM 44 and sets (resets) the read out CapCnt value to 0, and thereafter stores the CapCnt value to a predetermined area of the EEPROM 44 (step S44). The control section 40 continuously reads out a LastCapCnt value described below from the EEPROM 44 and sets (resets) the read out LastCapCnt value to 0, and thereafter stores the LastCapCnt value to a predetermined area of the EEPROM 44 (step S45). Then, the control section 40 finishes the fixed period empty suction operation process routine.

Here, an operation of the first timer 47 and the second timer 46 will be described based on the timing chart shown in FIG. 18.

For example, the case where the time when the power source of the ink jet type printer 11 was turned on should be 0, printing was started after 200 hours later, the fixed period empty suction was performed after 100 hours from starting the printing, and printing was finished after 150 hours from the fixed period empty suction was performed will be described.

The nozzle forming surface 19*a* of the recording head 19 is opened by the cap 23 at the print start time, the nozzle forming surface 19*a* of the recording head 19 is opened by the cap 23 at the fixed period empty suction time, and the nozzle forming surface 19*a* of the recording head 19 is sealed by the cap 23 at the print finish time. In this case, the first timer 47 measures 100 hours of from the print start time to the fixed period suction time as the cap open count time T2, and newly measures 150 hours of from the fixed period suction time to the print finish time as the cap open count time T2 after reset the time. On the other hand, the second timer 46 measures 250 hours of from the print start time to the print finish time as the cumulative time (non-sealing cumulative time) while cap 23 is opened.

Figure 11:
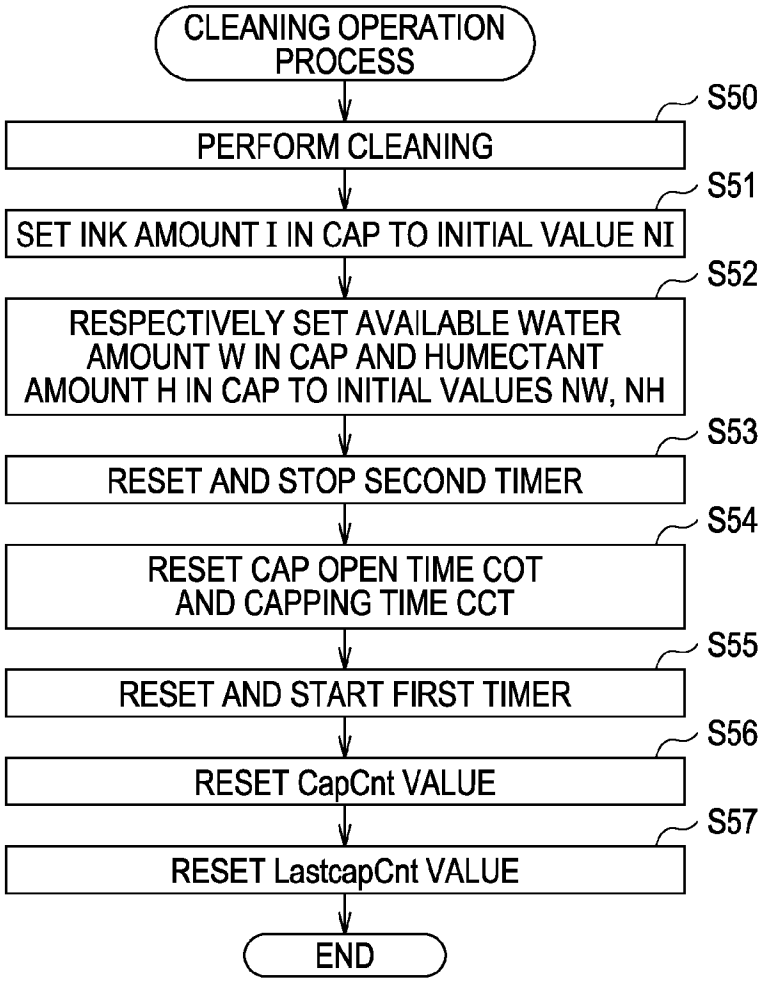
FIG. 11 is a flow chart showing a cleaning operation process routine of the first embodiment.

Next, cleaning operation process routine performed at cleaning time of the recording head 19 among the control process routine performed by the control section 40 of the embodiment will be described based on FIG. 11.

The control section 40 performs cleaning (step S50). Subsequently, the control section 40 set the ink amount I in the cap to an initial value NI (step S51). The initial value NI is an ink amount of fresh ink (ink equivalent to new ink accommodated in the ink cartridge 21) remaining in the cap right after the cleaning and preliminarily obtained by experiment or the like and stored in the ROM 42. Subsequently, the control section 40 set the available water amount W in the cap and the humectant amount H in the cap in the flesh ink remaining in the cap right after the cleaning respectively to an initial value NW (initial available water amount) and an initial value NH (step S52). The initial value NW and the initial value NH are preliminarily obtained by experiment or the like and stored in the ROM 42.

The control section 40 continuously resets and stops the second timer 46 (step S53). Subsequently, the control section 40 resets the cap open time COT and the capping time CCT (step S54). Then, the control section 40 resets and starts the first timer 47 (step S55).

Subsequently, the control section 40 reads out the CapCnt value from the EEPROM 44 and sets (resets) the read out CapCnt value to 0, and thereafter stores the CapCnt value to a predetermined area of the EEPROM 44 (step S56). The control section 40 continuously reads out the LastCapCnt value described below from the EEPROM 44 and sets (resets) the read out LastCapCnt value to 0, and thereafter stores the LastCapCnt value to a predetermined area of the EEPROM 44 (step S57). Then, the control section 40 finishes the cleaning operation process routine.

Figure 12:
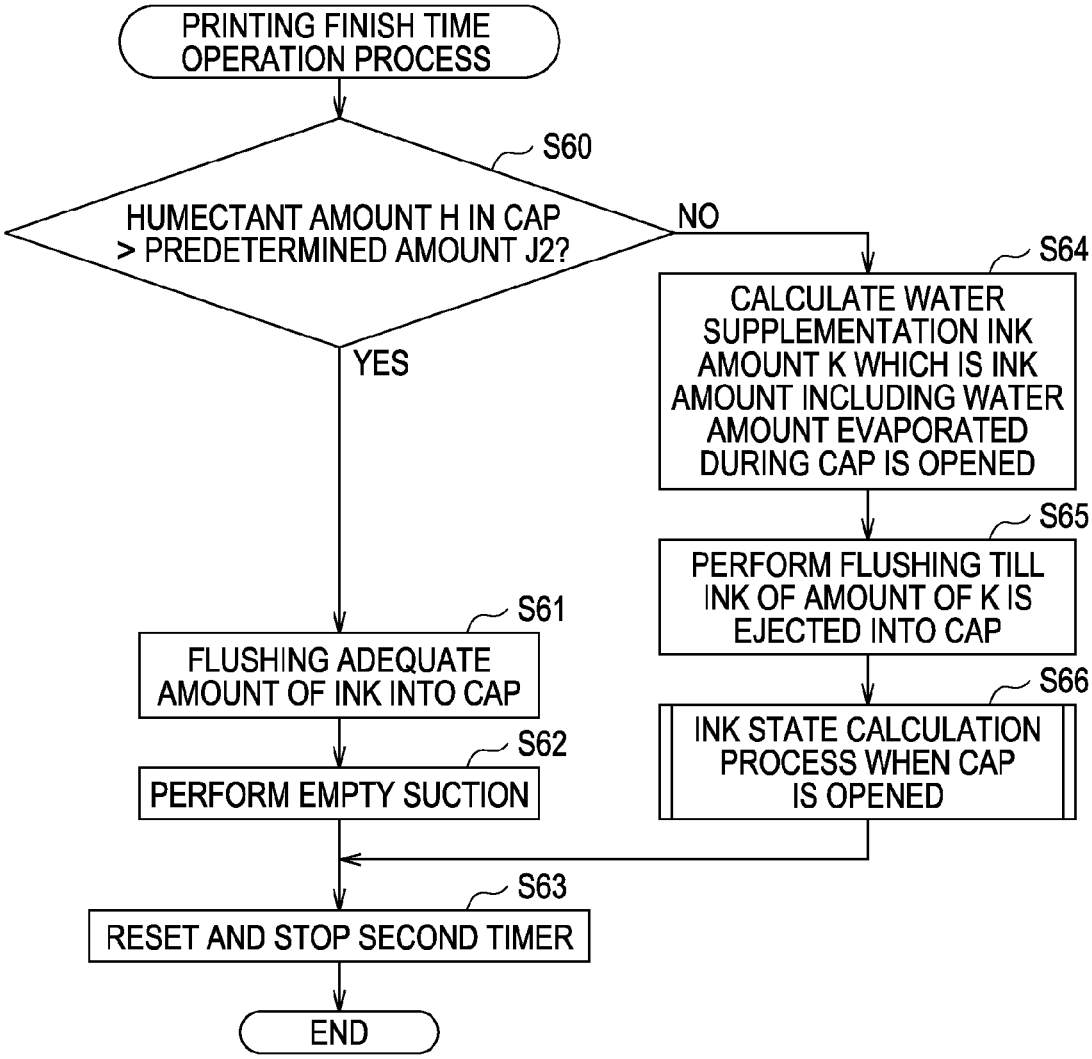
FIG. 12 is a flow chart showing a print finish time operation process routine of the first embodiment.

Next, a print finish time operation process routine performed at print finish time among the control process routine performed by the control section 40 of the embodiment will be described based on FIG. 12.

The control section 40 judges whether the humectant amount H in the cap is lager than a predetermined amount J2 preliminarily set by experiment or the like and stored in the ROM 42 or not (step S60). When the judged result in step S60 is positive, the control section 40 flushes an adequate amount of ink (sufficient amount for flowing the humectant in the cap 23; amount preliminarily obtained by experiment or the like) into the cap 23 (step S61). The control section 40 continuously drives the tube pump 30 to perform empty suction for discharging the ink in the cap 23 (step S62), and thereafter shifts the process to step S63 described below.

On the other hand, when the judged result in step S60 is negative, the control section 40 calculates the water amount corresponding to the amount to be reduced from the initial value NH (initial available water amount) by evaporating from the inside of the cap 23 during the cap 23 is opened based on the cumulative time while the cap 23 is opened, the size of the cap 23, the type of the ink, and the like to calculate a water supplementation ink amount K which is an ink amount including the water amount (step S64). The control section 40 continuously performs flushing into the cap 23 till the ink of the amount corresponding to the water supplementation ink amount K is ejected (supplemented) into the cap 23 (step S65).

Subsequently, the control section 40 performs ink state calculation process at cap open time described below (ink state calculation process routine at cap open time shown in FIG. 15) (step S66), and thereafter shifts the process to step S63 described below. In step S63, the control section 40 resets and stops the second timer 46, and then, the control section 40 finishes the print finish time operation process routine.

Figure 13:
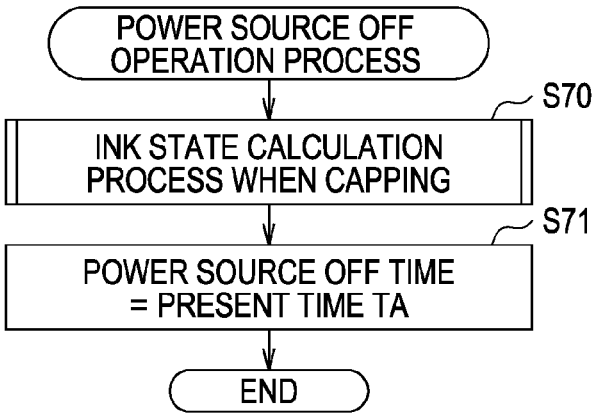
FIG. 13 is a flow chart showing a power source off operation process routine of the first embodiment.

Next, power source off operation process routine performed when power sour of the ink jet type printer 11 is turned off among the control process routine performed by the control section 40 of the embodiment will be described based on FIG. 13.

The control section 40 performs the ink state calculation process when capping described below (ink state calculation process routine when capping shown in FIG. 16) (step S70). The control section 40 continuously reads out the present time TA from the RTC 45 to store the present time TA into the EEPROM 44 as a power source off time (step S71), and then, the control section 40 finishes the power source off operation process routine.

Next, an ink state calculation process routine when cap is opened performed in step 41 and step S66 described above will be described based on FIG. 14.

The control section 40 reads out the cap open count time T2 from the first timer 47 (step S80). The control section 40 continuously updates the available water amount W in the cap (step S81). That is, the control section 40 calculates an available water amount TW in the ink newly ejected into the cap 23 (water amount except the water absorbed by the humectant in the ink newly ejected into the cap 23). Then, the control section 40 subtracts a multiplied value of an evaporation coefficient B when cap is opened preliminarily obtained by experiment or the like and stored in the ROM 42 and the cap open count time T2 read out in step S80 from the available water amount TW and adds the value to the available water amount W in the cap read out from the RAM 43. Then, the control section 40 writes the added result into a predetermined area of the RAM 43 as the available water amount W in the cap.

The control section 40 continuously updates the humectant mount H in the cap (step S82). That is, the control section 40 calculates a humectant amount TH in the ink newly ejected into the cap 23 to add the humectant amount TH to the humectant amount H in the cap read out from the RAM 43. Then, the control section 40 writes the added result into a predetermined area of the RAM 43 as the humectant mount H in the cap.

The control section 40 continuously updates the ink amount I in the cap (step S83). That is, the control section 40 calculates an ink amount TI newly ejected into the cap 23. Then, the control section 40 subtracts a multiplied value of the evaporation coefficient B when cap is opened and the cap open count time T2 read out in step S80 from the ink amount TI and adds the value to the ink amount I in the cap read out from the RAM 43. Then, the control section 40 writes the added result into a predetermined area of the RAM 43 as the ink amount I in the cap.

The control section 40 continuously calculates the available water amount ratio WH in the cap and the humectant amount ratio HH in the cap of the ink in the cap based on the available water amount W in the cap, the humectant amount H in the cap, and the ink amount I in the cap respectively updated in steps S81 to S83 (step S84). The control section 40 continuously resets the cap open time COT (step S84-1).

Subsequently, the control section 40 reads out the CapCnt value from the EEPROM 44 to store the read out CapCnt value in a predetermined area of the EEPROM 44 as the LastCapCnt value (step S84-2). The LastCapCnt value is the CapCnt value (cumulative amount of the ink ejected by flushing into the cap 23 previous time) counted till the point (right before the step S84-2 is performed). Subsequently, the control section 40 resets and start the first timer 47 (step S85), and thereafter finishes the ink state calculation process routine when cap is opened.

Next, an ink remaining amount calculation process routine in the cap performed in step S43 described below will be described based on FIG. 15.

The control section 40 judges whether the ink amount I in the cap is larger than the initial value NI or not (step S90). When the judged result in step S90 is positive, the control section 40 calculates the available water amount W in the cap and the humectant amount H in the cap after the fixed period empty suction based on the available water amount ration WH in the cap and the humectant amount ratio HH in the cap of the ink in the cap calculated in step S84 described above (step S91). The control section 40 continuously records the initial value NI into the RAM 43 as the ink amount I in the cap (step S92), and thereafter finishes the ink remaining amount calculation process routine in the cap. On the other hand, when the judged result in step S90 is negative, the control section 40 finishes the ink remaining amount calculation process routine in the cap.

Next, an ink state calculation process routine when capping performed in step S2 and step S70 described above will be described based on FIG. 16.

The control section 40 reads out the capping count time T3 from the first timer 47 (step S100). The control section 40 continuously updates the available water amount W in the cap (step S101). That is, the control section 40 subtracts a multiplied value of the evaporation coefficient A when capping and the capping count time T3 read out in step S100 from the available water amount W in the cap read out from the RAM 43 to write the subtracted result into a predetermined area of the RAM 43 as the available water amount W in the cap.

The control section 40 continuously updates the ink amount I in the cap (step S102). That is, the control section 40 subtracts the multiplied value of the evaporation coefficient A when capping and the capping count time T3 read out in step S100 from the ink amount I in the cap read out from the RAM 43 to write the subtracted result into a predetermined area of the RAM 43 as the ink amount I in the cap. The control section 40 continuously resets a power source off elapsed time (the time while the power source had been turned off) described below (step S102-1). Subsequently, the control section 40 resets and starts the first timer 47 (step S103), and thereafter finishes the ink state calculation process routine when capping.

Figure 17:
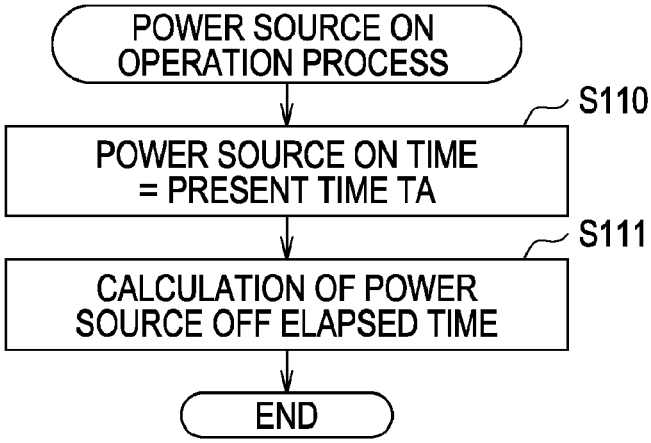
FIG. 17 is a flow chart showing a power source on operation process routine of the first embodiment.

Then, a power source on operation process routine performed when power source of the ink jet type printer 11 is on among the control process routine performed by the control section 40 of the embodiment will be described based on FIG. 17.

The control section 40 reads out the present time TA from the RTC 45 to store the present time TA into a predetermined area of the RAM 43 as a power source on time (step S110). Subsequently, the control section 40 reads out the power source on time from the RAM 43, reads out the power source off time from the EEPROM 44, and subtracts the power source off time from the power source on time. Thereby, the control section 40 calculates the power source elapsed time to store the calculated result into the RAM 43 as the power source off elapsed time (the time while the power source had been off state) (step S111). Then, the control section 40 finishes the power source on operation process routine.

As described above, in the embodiment, it is estimated that the available water amount W in the cap becomes smaller due to evaporation or the like as the elapsed time T1 from the previous cleaning becomes longer. Accordingly, the control section 40 performs maintenance control so that the ink amount discharged into the cap 23 from the nozzle 20 becomes larger as the elapsed time T1 becomes longer.

Figure 7:
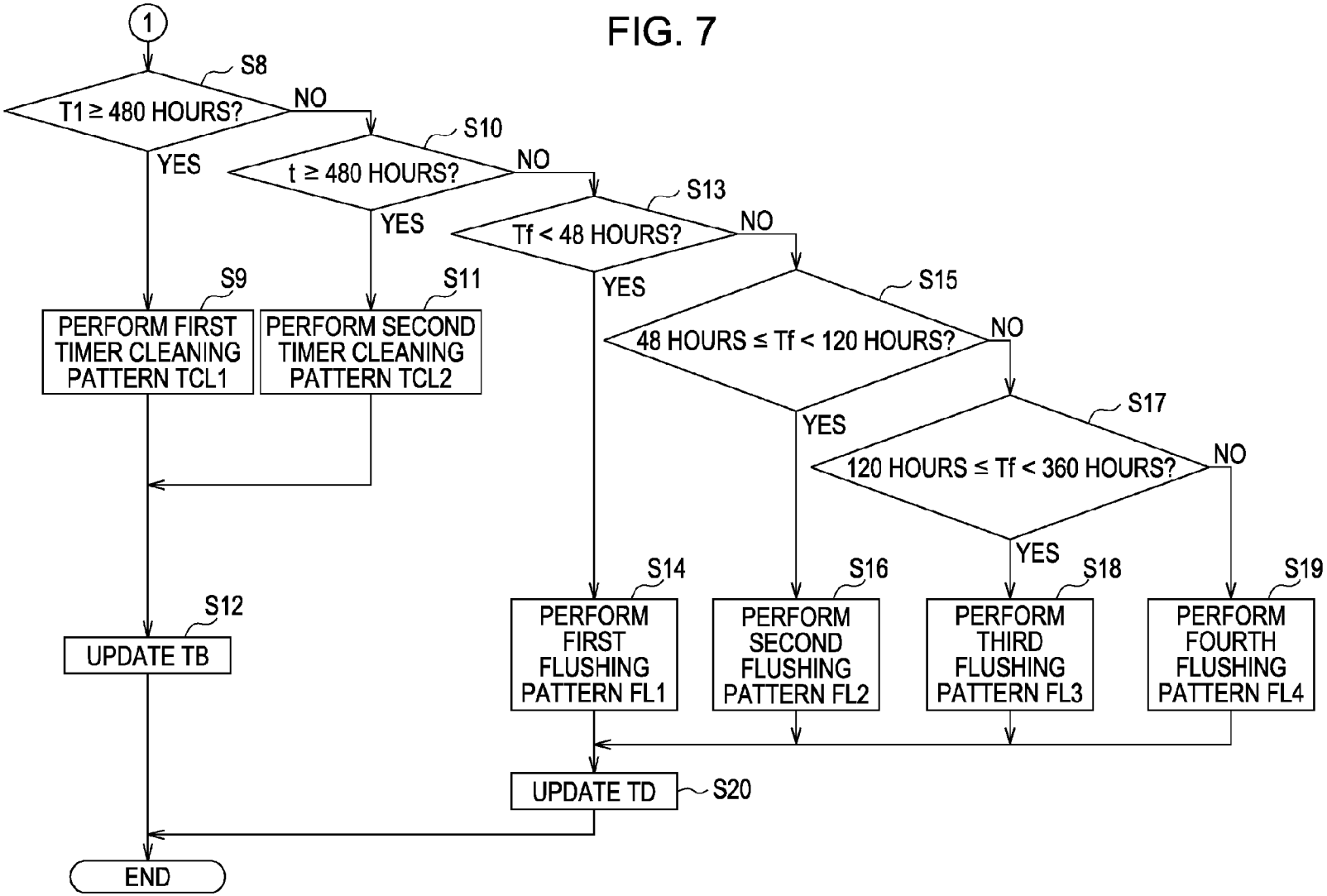
FIG. 7 is a flow chart showing an operation process routine before starting printing of the first embodiment.

That is, as shown in FIG. 7, the control section 40 performs the first timer cleaning pattern TCL1 in which the ink amount discharged into the cap 23 from the nozzle 20 is largest when the elapsed time T1 is not less than the longest 480 hours and performs the first flushing pattern FL1 in which the ink amount discharged into the cap 23 from the nozzle 20 is smallest when the elapsed time T1 is less than the shortest 48 hours.

As described above, according to the first embodiment described in detail, effects described below can be obtained.

(1) In the state where the nozzle forming surface 19*a* of the recording head 19 is sealed by the cap 23, clogging of the nozzle 20 tends to occur as the available water amount W in the cap decreases, so that ejection trouble of ink at print start time tends to occur. Accordingly, it is necessary to increase the ink amount forcibly discharged into the cap 23 from the nozzle 20 as the available water amount W in the cap decreases. In this regard, according to the embodiment, the timer cleaning and the flushing are selectively performed so that the ink amount discharged into the cap 23 from the nozzle 20 decreases when the available water amount W in the cap is large than when small, which makes it possible to surly restrain ejection trouble of ink at print start time.

(2) The control section 40 calculates the available water amount W in the cap based on the cumulative time when the cap 23 is opened, the capping time CCT, and the cap open time COT, so that the calculation accuracy of the available water amount W in the cap can be improved.

(3) The control section 40 calculates a water mount corresponding to the amount of the available water amount W in the cap evaporated from inside of the cap 23 during the cap is opened to be reduced from the initial value NW, calculates the water supplementation ink amount K which is an ink amount including the water amount, and performs flushing into the cap 23 until the ink amount corresponding to the water supplementation ink amount K is supplemented in the cap 23.

Accordingly, when the available water amount W in the cap becomes less than the initial value NW, ink is supplemented into the cap and the available water amount W in the cap can be returned to the initial value NW. Accordingly, the cap 23 can be maintained in a high wet condition, and the clogging of the nozzle 20 can be preferably restrained.

(4) the control section 40 drives the tube pump 30 so that the humectant is to be discharged from the cap 23 when the humectant amount H in the cap exceeds the predetermined amount J2 preliminarily set, so that the humectant amount in the cap 23 can be restrained not more than the predetermined amount J2. Accordingly, the water amount deprived from the ink in the nozzle 20 by the humectant in the cap 23 can be reduced and the clogging of the cap 20 can be preferably restrained.

Second Embodiment

Hereinafter, a second embodiment of the invention will be described focusing on different points from the above described first embodiment.

Figures 19, 20:
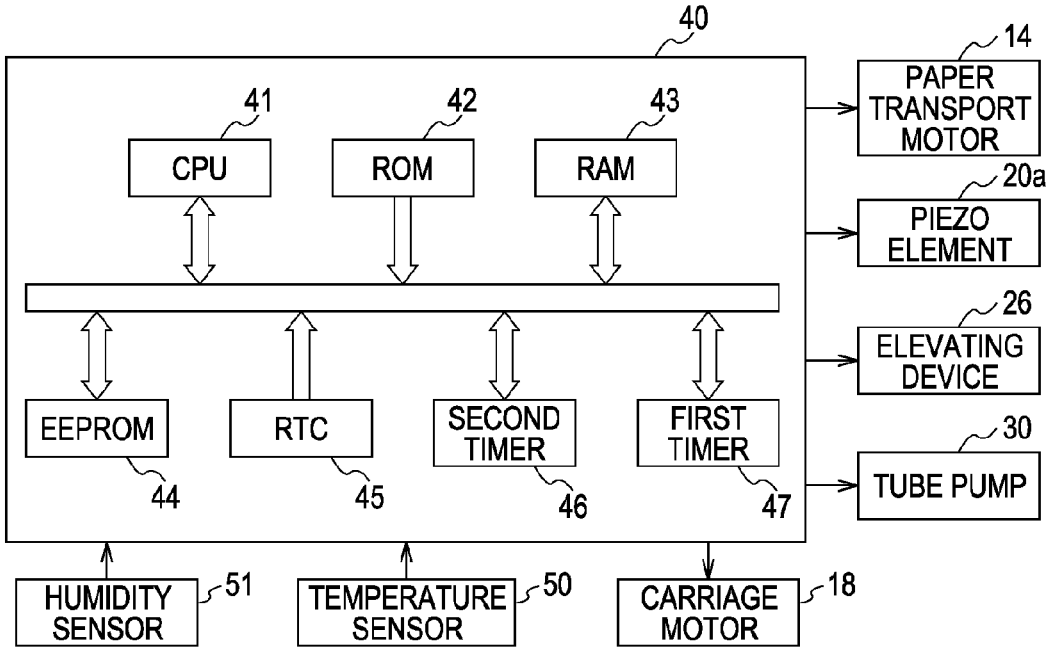
FIG. 19 is a block circuit diagram showing an electronic structure of an ink jet type printer of a second embodiment.
FIG. 20 is a table showing relationship of an available water amounts in the cap, a discharge ink amount, and a maintenance pattern to be performed of the second embodiment.

As shown in FIG. 19, in the second embodiment, a temperature sensor 50 as temperature measuring unit that measures the atmosphere temperature of the recording head 19 (see FIG. 1) and a humidity sensor 51 as humidity measuring unit that measures the humidity temperature of the recording head 19 are equipped in the ink jet type printer 11 (see FIG. 1). The temperature sensor 50 and the humidity sensor 51 are electrically connected to the control section 40.

A calculating formula ($M=k\cdot dp/dx\cdot S$) . . . (A) for obtaining a water penetration amount M per a predetermined means time ST evaporated in the cap and penetrated the wall portion constituting the cap 23 to be diffused out of the cap 23 in the state where the nozzle forming surface 19*a* of the recording head 19 is sealed by the cap 23 is stored in the ROM 42. In the calculating formula, k denotes a diffusion coefficient preliminarily determined by experiment or the like, p denotes a water vapor concentration around the cap 23, x denotes the thickness (distance between inside and outside of the cap 23) of the wall portion constituting the cap 23, and S denotes the total area of the inner surface of the cap 23. In this case, the water vapor concentration p is a value determined by the atmosphere temperature and the atmosphere humidity of the recording head 23.

Further, as shown in FIG. 20, a table is stored in the ROM 42 showing a relation between an available water amount W in the cap before starting printing, a discharge ink amount (discharge liquid amount) HI which is an ink amount discharged into the cap 23 from each nozzle 20 of the recording head 19 based on the value of the available water amount W in the cap, and a maintenance pattern performed by the maintenance unit 22 so as to correspond with the discharge ink amount HI.

Then, in regard to the maintenance, in the embodiment, by making difference in the discharge ink amount HI, a plurality of the maintenance patterns, that is, a cleaning pattern CL, a first flushing pattern FL1, a second flushing pattern FL2, a third flushing pattern FL3, a fourth flushing pattern FL4 of five types are set.

In this case, the cleaning pattern CL is set so that the discharge ink amount HI becomes 200 mg and the first flushing pattern FL1 is set so that the discharge ink amount HI becomes 40 mg. Further, in this case, the second flushing pattern FL2 is set so that the discharge ink amount HI becomes 80 mg, the third flushing pattern FL3 is set so that the discharge ink amount HI becomes 120 mg, and the fourth flushing pattern FL4 is set so that the discharge ink amount HI becomes 160 mg.

That is, when the available water amount W in the cap is a negative value, the cleaning pattern CL is performed, and when not less than 0 mg and less than 50 mg, the fourth flushing pattern FL4 is performed. Further, when the available water amount W in the cap is computationally not less than 50 mg and less than 100 mg, the third flushing pattern FL3 is performed, when not less than 100 mg and less than 150 mg, the second flushing pattern FL2 is performed, and when not less than 150 mg, the first flushing pattern FL1 is performed.

Figure 21:
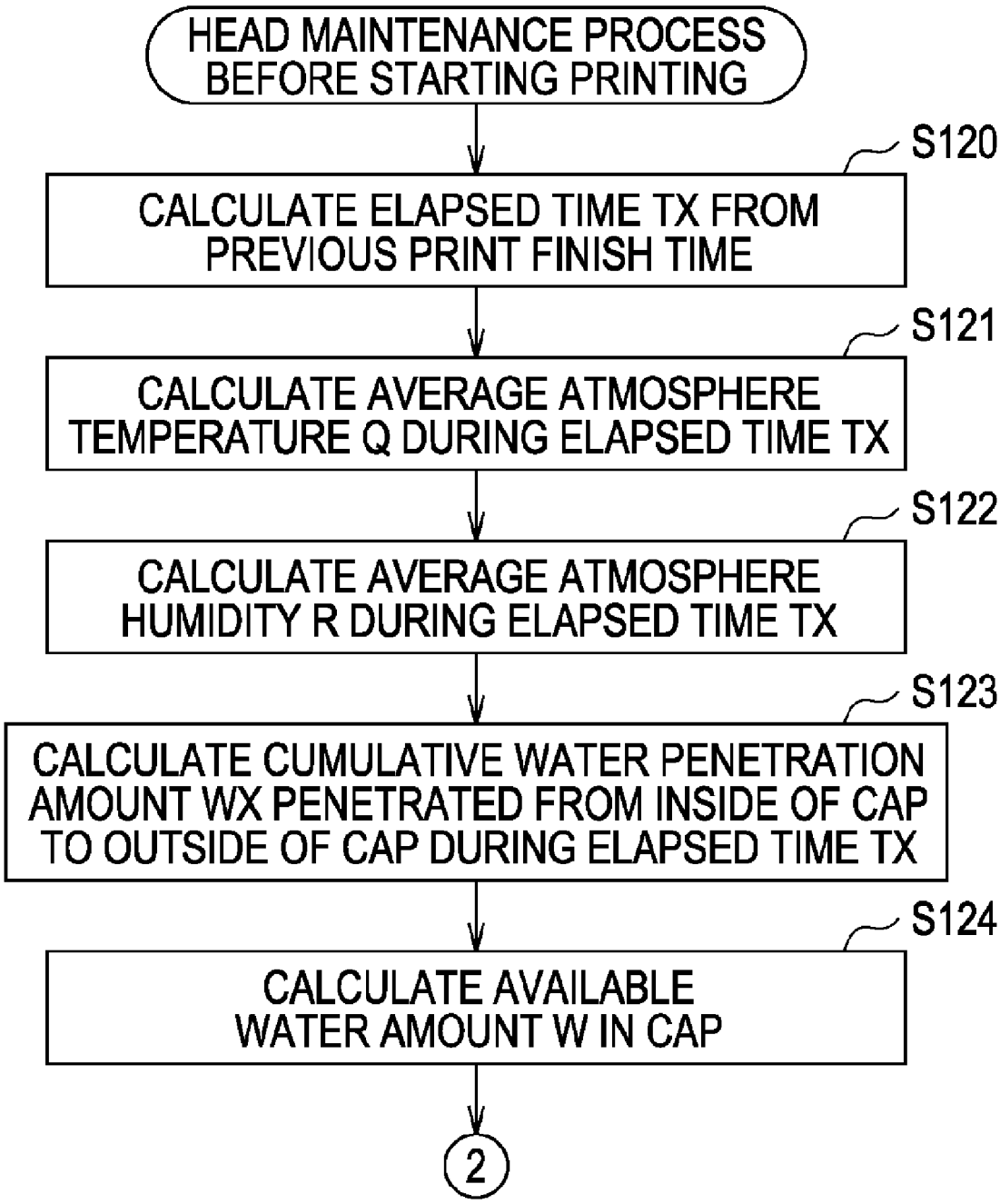
FIG. 21 is a flow chart showing a head maintenance process routine before starting printing of the second embodiment.
Figure 22:
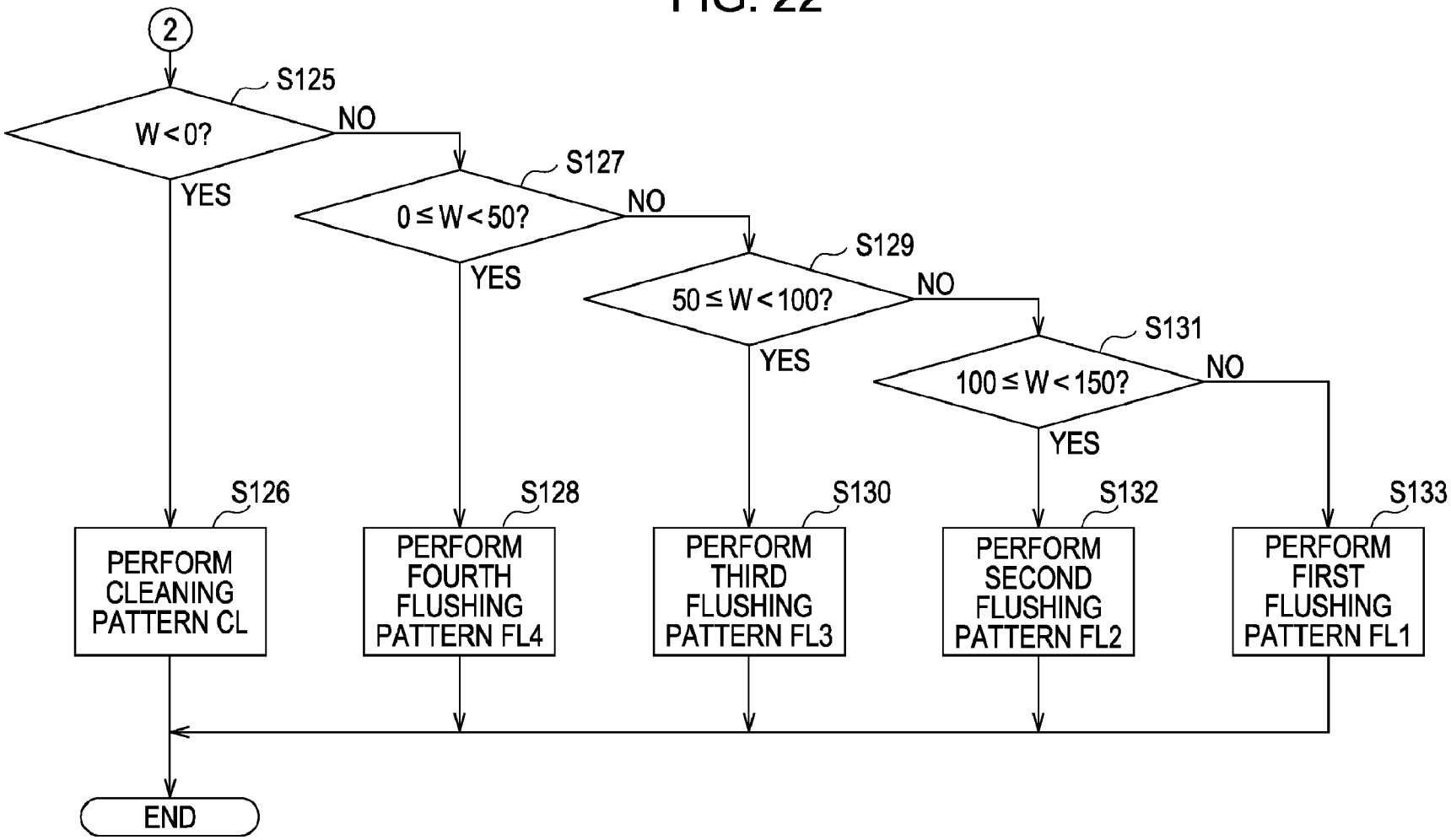
FIG. 22 is a flow chart showing a head maintenance process routine before starting printing of the second embodiment.

Next, a head maintenance process routine before starting printing for performing maintenance of the recording head 19 by the maintenance unit 22 before starting printing among the control process routine performed by the control section 40 in the embodiment will be described based on FIGS. 21 and 22.

The control section 40 reads out the previous print finish time TG which is the time of the previous print finish time from the EEPROM 44 and reads out the present time TA from the RTC 45 to subtract the previous print finish time TG from the present time TA, thereby calculating the elapsed time TX from the previous print finish time (step S120). Subsequently, the control section 40 calculates an average atmosphere temperature Q of the recording head 19 during the elapsed time TX based on an input signal from the temperature sensor 50 (step S121).

Subsequently, the control section 40 calculates an average atmosphere humidity R of the recording head during the elapsed time TX based on an input signal from the humidity sensor 51 (step S122). Subsequently, the control section 40 reads out the calculating formula (A) from the ROM 42 and calculate the moisture penetration amount M per the predetermined unit time ST based on the calculating formula (A) to multiply the calculated moisture penetration amount M by the elapsed time TX, thereby calculating a cumulative water penetration amount WX penetrated from inside of the cap 23 to outside of the cap 23 during the elapsed time TX (step S123).

Subsequently, the control section 40 calculates the available water amount W in the cap by subtracting a moisture absorbed water amount WR absorbed by the humectant and the cumulative water penetration amount WX from a whole water amount WP exist in the cap 23 at the previous print finish time (step S124). Subsequently, the control section 40 judges whether the available water amount W in cap calculated in step S124 is a negative value less than 0 mg or not (step S125). When the judged result in step S125 is positive, the control section 40 performs the cleaning pattern CL (step S126), and thereafter finishes the head maintenance process routine before starting printing.

On the other hand, when the judged result in step S125 is negative, the control section 40 judges whether the available water amount W in the cap calculated in step S124 is not less than 0 mg and less than 50 mg or not (step S127). When the judged result in step S127 is positive, the control section 40 performs the fourth flushing pattern FL4 (step S128), and thereafter finishes the head maintenance process routine before starting printing.

On the other hand, when the judged result in step S127 is negative, the control section 40 judges whether the available water amount W in the cap calculated in step S124 is not less than 50 mg and less than 100 mg or not (step S129). When the judged result in step S129 is positive, the control section 40 performs the third flushing pattern FL3 (step S130), and thereafter finishes the head maintenance process routine before starting printing.

On the other hand, when the judged result in step S129 is negative, the control section 40 judges whether the available water amount W in the cap calculated in step S124 is not less than 100 mg and less than 150 mg or not (step S131). When the judged result in step S131 is positive, the control section 40 performs the second flushing pattern FL2 (step S132), and thereafter finishes the head maintenance process routine before starting printing. On the other hand, when the judged result in step S131 is negative, the control section 40 performs the first flushing pattern FL1 (step S133), and thereafter finishes the head maintenance process routine before staring printing.

Next, the process based on the above described head maintenance process routine before staring printing will be described with a concrete example.

Here, the whole water amount WP in the cap 23 at the previous print finish time shall be 500 mg, similarly, the humectant amount in the cap 23 shall be 120 mg, and the moisture absorbed water amount WR absorbed by the humectant of 120 mg shall be 300 mg when the humidity in the cap is assumed to be 100%. In addition, the elapsed time TX from the previous print finish time shall be 10 days and the average atmosphere temperature Q and the average atmosphere humidity R of the recording head 19 during the ten days respectively shall be 25° C. and 42% RH.

Then, the predetermined means time ST should be one day and when the water penetration amount M per the one day was calculated by the calculating formula (A), the water penetration amount M was 1.54 mg. Accordingly, the cumulative water penetration amount WX is to be 1.54 mg×10 days=15.4 mg. Accordingly, the available water amount W in the cap becomes 500 mg−300 mg−15.4 mg=184.6 mg. As a result, the discharge ink amount HI becomes 40 mg from the table shown in FIG. 20. Similarly, suppose that the elapsed time TX is one month (30 days) and six months (180 days), the discharge ink amount HI respectively becomes 80 mg and 120 mg.

In addition, similarly to the above description, the discharge ink amount HI when the elapsed time TX shall be 10 days, one month, and six months when the average atmosphere temperature Q and the average atmosphere humidity R of the recording head 19 respectively shall be 29° C. and 35% RH respectively becomes 80 mg, 120 mg, and 160 mg. Further, similarly to the above description, the discharge ink amount HI when the elapsed time TX shall be 10 days, one month, and six months when the average atmosphere temperature Q and the average atmosphere humidity R of the recording head 19 respectively shall be 29° C. and 22% RH respectively becomes 120 mg, 160 mg, and 200 mg.

Summary of the above result is shown in the table shown in FIG. 23. According to the table, when the average atmosphere temperature Q is the same, the discharge ink amount HI becomes larger as the average atmosphere humidity R becomes lower as the available water amount W in the cap becomes smaller. Further, when the average atmosphere humidity R is the same, it is considered that the discharge ink amount HI becomes larger as the average atmosphere temperature Q becomes higher as the available water amount W in the cap becomes smaller.

In such a manner, before starting printing, the viscosity of the ink in each nozzle 20 of the recording head 19 becomes larger as the available water amount W in the cap decreases. Accordingly, it is necessary to increase the amount of the ink (discharge ink amount HI) discharged into the cap 23 by the maintenance (flushing or cleaning) of the recording head 19 performed before starting printing. In this regard, in the embodiment, the discharge ink amount HI before starting printing is adequately adjusted based on the available water amount W in the cap calculated in view of the cumulative water penetration amount WX calculated based on the circumstance (temperature and humidity) around the recording head 19 and the elapsed time TX from the previous print finish time, so that the waste of ink can be eliminated.

According to the second embodiment described above in detail, effects described below can be obtained.

(5) In the state where the nozzle forming surface 19*a* (each nozzle 20) of the recording head 19 is sealed by the cap 23, that is, during pausing of printing, clogging of the each nozzle 20 tends to occur by increased viscosity of the ink as the available water amount in the cap decreases. Accordingly, it is required to increase the discharge ink amount HI discharged into the cap 23 from each nozzle 20 as the available water amount W in the cap decreases when performing the maintenance for forcibly discharging the ink into the cap 23 from each nozzle 20 before starting printing. However, in this case, increase of the discharge ink amount HI more than necessity result in waste consumption of ink. In this regard, according to the embodiment, the discharge ink amount HI can be adequately adjusted based on the available water amount W in the cap, so that the waste consumption of ink when flushing or cleaning performed before starting printing can be restrained.

In addition, the above described available water amount W in the cap is calculated in view of the cumulative water penetration amount WX penetrated from inside of the cap 23 to the outside of the cap 23 calculated based on the elapsed time TX from the previous print finish time and the average atmosphere temperature Q and the average atmosphere humidity R of the recording head 19 during the elapsed time TX. Accordingly, the accuracy of the available water amount W in the cap before starting printing can be improved. As a result, the discharge ink amount HI can be more appropriately adjusted.

MODIFICATIONS

It should be noted here that the each embodiment described above can be modified as below.

In the first embodiment, a timer for measuring the cap open count time T2 and a timer for measuring the capping count time T3 may be separately provided.

In the second embodiment, the discharge ink amount HI may be linearly adjusted based on the available water amount W in the cap.

In the head maintenance process routine before starting printing in the second embodiment, the average atmosphere temperature Q and the average atmosphere humidity R of the recording head 19 respectively may be the atmosphere temperature the atmosphere humidity of the recording head 19 right before starting printing.

In the second embodiment, the available water amount W in the cap is not necessary to be calculated based on the cumulative water penetration amount WX.

In the second embodiment, the cumulative water penetration amount WX is not necessary to be calculated based on the average atmosphere temperature Q and the average atmosphere humidity R of the recording head 19. Alternatively, the cumulative water penetration amount WX may be calculated based on one of the average atmosphere temperature Q and the average atmosphere humidity R of the recording head 19.

In each embodiment described above, the liquid ejecting apparatus is embodied as the ink jet type printer 11.

However, the liquid ejecting apparatus may be utilized for, for example, manufacturing of a color filter of a liquid crystal display or the like, and pixel formation of an organic EL display or the like.

The invention claimed is:

1. A liquid ejecting apparatus equipped with a liquid ejecting head for ejecting liquid including humectant and water from a nozzle formed on a nozzle forming surface and a cap which can seal the nozzle forming surface of the liquid ejecting head comprising:

liquid amount detecting unit that detects an amount of the liquid discharged into the cap from the nozzle;

available water amount calculating unit that calculates an available water amount which is a water amount except water absorbed by humectant in the liquid in the cap based on a result detected by the liquid amount detecting unit; and control unit that performs maintenance control for forcibly discharging liquid from the nozzle into the cap based on a result calculated by the available water amount calculating unit so that the amount of the liquid discharged from the nozzle becomes smaller when the available water amount is large than when small.

2. The liquid ejecting apparatus according to claim 1, comprising non-sealing duration time measuring unit that measures a non-sealing duration time of the nozzle forming surface by the cap for every one time, sealing duration time measuring unit that measures a sealing duration time of the nozzle forming surface by the cap for every one time, and non-sealing cumulative time measuring unit that measures a non-sealing cumulative time of the nozzle forming surface by the cap, wherein the available water amount calculating unit that calculates the available water amount based on a result measured by the non-sealing duration time measuring unit, a result measured by the sealing duration time measuring unit, and a result measured by the non-sealing cumulative time measuring unit.

3. The liquid ejecting apparatus according to claim 1 or claim 2, wherein when the available water amount based on a result calculated by the available water amount calculating unit is smaller than an initial available water amount in the cap in a preliminarily set initial state, the control unit that performs the maintenance control so that the liquid of a liquid amount including the available water amount corresponding to the difference of the available water amount and the initial available water amount is to be ejected from the nozzle into the cap after finishing liquid ejection.

4. The liquid ejecting apparatus according to claim 1, further comprising suction unit which can suction the inside of the cap, wherein the control unit performs the maintenance control by operating the suction unit to perform suction so that the humectant is to be discharged from the cap when the amount of the humectant discharged into the cap exceeds a preliminarily set predetermined amount.

5. The liquid ejecting apparatus according to claim 1, wherein the control unit that calculates a discharge liquid amount which is an amount of the liquid forcibly discharged into the cap from the nozzle based on the available water amount and performs the maintenance control so that the liquid of the calculated discharge liquid amount is to be forcibly discharged from the nozzle into the cap before starting liquid ejection.

6. The liquid ejecting apparatus according to claim 5, wherein the control unit that measures an elapsed time from the previous liquid ejection finish time, calculates a cumulative water penetration amount penetrated from inside of the cap to outside of the cap from the previous liquid ejection finish time based on the measured result, and calculates the available water amount based on the calculated cumulative water penetration amount.

7. The liquid ejecting apparatus according to claim 6, comprising temperature measuring unit that measures an atmosphere temperature of the liquid ejecting head, wherein the control unit calculates the cumulative water penetration amount based on a result of the atmosphere temperature measured by the temperature measuring unit during the elapsed time.

8. The liquid ejecting apparatus according to claim 6 or claim 7, comprising humidity measuring unit that measures an atmosphere humidity of the liquid ejecting head, wherein the control unit calculates the cumulative water penetration amount based on a result of the atmosphere humidity measured by the humidity measuring unit during the elapsed time.

9. A maintenance method of a liquid ejecting apparatus equipped with a liquid ejecting head for ejecting liquid including humectant and water from a nozzle formed on a nozzle forming surface and a cap which can seal the nozzle forming surface of the liquid ejecting head, comprising the steps of:

detecting an amount of the liquid discharged into the cap from the nozzle;

calculating an available water amount which is a water amount except water absorbed by humectant in the liquid in the cap based on the detected amount of the liquid; and performing maintenance for forcibly discharging liquid from the nozzle into the cap so that the amount of the liquid discharged from the nozzle becomes smaller when the calculated available water amount is large than when small.

* * * * *